US006142461A

United States Patent [19]

Asao et al.

[11] Patent Number: 6,142,461

[45] Date of Patent: Nov. 7, 2000

[54] SHEET PROCESSING DEVICE

[75] Inventors: Yuusuke Asao; Takehiro Yamakawa, both of Yamanashi-ken, Japan

[73] Assignee: Nisca Corporation, Yamanashi-ken, Japan

[21] Appl. No.: 09/049,031

[22] Filed: Mar. 27, 1998

[30] Foreign Application Priority Data

| | | | |
|---|---|---|---|
| Mar. 31, 1997 | [JP] | Japan | 9-097960 |
| Oct. 17, 1997 | [JP] | Japan | 9-284753 |
| Nov. 20, 1997 | [JP] | Japan | 9-336381 |

[51] Int. Cl.[7] ..... B65H 33/04; B65H 29/34

[52] U.S. Cl. ..... 270/58.09; 270/58.11; 271/189; 271/218; 271/233

[58] Field of Search ..... 270/58.09, 58.11 C, 270/58.14; 271/189 C, 218 C, 161, 265.01, 265.02, 265.04, 233 C

[56] References Cited

U.S. PATENT DOCUMENTS

| | | | |
|---|---|---|---|
| 3,479,932 | 11/1969 | Stal et al. | 271/218 |
| 4,385,757 | 5/1983 | Muller | 271/189 |
| 4,593,896 | 6/1986 | Nakamura | 271/189 |
| 5,098,074 | 3/1992 | Mandel et al. . | |
| 5,895,036 | 4/1999 | Asao | 270/58.09 |
| 5,971,384 | 11/1999 | Asao | 270/58.13 |

FOREIGN PATENT DOCUMENTS

| | | |
|---|---|---|
| 6-211414 | 8/1994 | Japan . |
| 8-91686 | 4/1996 | Japan . |

*Primary Examiner*—Christopher P. Ellis
*Assistant Examiner*—Kenneth W. Bower
*Attorney, Agent, or Firm*—Kaensaka & Takeuchi

[57] ABSTRACT

A sheet processing device according to the present invention is formed of an image forming device, an ejecting device and a stacking device; wherein the sheet processing device further includes an auxiliary support device which is disposed at a distal side in a sheet ejecting direction of the support device. The auxiliary support device is rotatably moved between a support position for supporting at least a forward end of the sheet and a retracting position from the support position. Whereby the stacking area of the support device can be varied, and the ejecting of the sheets temporarily stacked on the stacking device can be easily accomplished.

14 Claims, 26 Drawing Sheets

SHEET PROCESSING DEVICE

BACKGROUND OF THE INVENTION AND RELATED ART STATEMENT

The present invention relates to an image forming apparatus such as a copier or printer, or a sheet processing device such as a sorter or a finisher, which is disposed in the image forming device, and especially relates to a sheet processing device in which, apart from stacking means such as a stacking part on which sheets can be stacked, support means such as a sheet holding part for being capable of temporarily holding the sheet supplied from image forming means is disposed on an upperstream side than the stacking means.

Conventionally, there has been known an image forming apparatus, a sorter, a finisher or the like which is provided with a sheet holding part wherein when a plurality of sheets is stacked and becomes a set of predetermined number of sheets, the set of sheets is processed, such as stapled or punch-holed, and then the set of sheets is rejected to the stack part.

Also, in this kind of the sheet holding part, at the time of temporarily staking sheets, the longer a stacking surface of the sheet toward the ejection direction is, the larger a size of the sheet can be stacked, and also this structure enables stable processing by preventing displacement of the set of the sheets when the set of the sheets is processed.

On the other hand, after processing the set of sheets, in order to facilitate ejecting the set of sheets from the sheet holding part to the stack part, the shorter the stacking surface of the sheet toward the ejection direction is, the easier ejection of the sheet to the stack part is.

Thus, as disclosed in U.S. Pat. No. 5,098,074 and in Japanese Patent Publication (KOKAI) No. 6-211414, it has been considered that an extension tray, which is extendable and retractable to the forward end of the ejection direction, is provided under the sheet holding part, and in the condition that the sheets are temporarily stacked on the sheet holding part, the extension tray is extended such that the tray is projected from the forward end in the ejection direction of the sheet holding part, so as to secure the stacking surface sufficiently; after the processing the sheets, the extension tray is retracted such that the tray is buried from the forward end part in the ejection direction of the sheet holding part so as to shorten the stacking surface.

However, since this freely extendable and retractable extension tray is simply extended or retracted, especially, in order to eject the processed sheets which are plurally stacked in a bundle (even not in case of stapling, sheets are in a bundle to eject at once) to the stack part, not only more ejecting force is required than ejecting sheet by sheet, but also an ejection roller for this ejection directly applies compulsive force only onto the uppermost sheet and the lowermost sheet in the set of sheets. Accordingly, it has been difficult to eject the set of processed sheets easily and orderly. Also, in the prior art disclosed in the aforementioned Patent Publications, balance between timing for placing into the stacking part and timing for retreating is not determined in consideration of orderliness.

Incidentally, in the sheet processing device structured as described above, there has been a problem that if a long sheet post-processing path is secured, the entire sheet processing device becomes large-sized.

Thus, it is considered to provide auxiliary support means for extending the sheet post-processing path in the downstream side of the sheet transferring direction. Sizes of the sheets in case of image forming are, however, not always the same, and for example, under the condition that a sheet of a B5 size is placed traversely longitudinal, in case the length of the sheet in the transferring direction is comparatively long, there is no deed to extend the sheet post-processing path.

As the sheet processing device, for example, there has been known the apparatus disclosed in the Japanese Patent Publication (KOKAI) No. 8-91686. This apparatus is structured that, in case of ejecting sheets stapled on the sheet holding part, a first motor is driven to lower a pinch roller such that the sheets are nipped between the pinch roller and an ejection roller, and subsequently a second motor is driven to rotate the ejection roller such that the sheets are nipped between the ejection roller and the pinch roller and ejected onto the stacking part.

However, in the above described sheet processing device, since driving for ascending and descending of the pinch roller and driving for rotating the ejection roller are operated by separate motors, the entire apparatus becomes large-sized. Also, driving by these motors has to be controlled by actuation of detecting means and actuator, which are disposed in the respective motors; accordingly, there was a possibility that a lag occurs between timing for nip operation and timing for ejecting operation due to dispersion in accuracy of the actuators.

An object of the invention is to provide a sheet processing device, wherein not only a stacking area of support means in a sheet holding part or the like can be variable, but also ejecting one or more sheets temporarily stacked to stacking means can be facilitated.

Another object of the invention is to achieve a sheet processing device with high reliability, wherein common driving means, which controls driving timing for at least the first ejecting means out of the first and second ejecting means and contacting-separating means or the like for contacting and separating the second ejecting means with respect to the first ejecting means, is provided so as to eliminate a timing lag.

SUMMARY OF THE INVENTION

To achieve the above objects, a sheet processing device of the invention is formed of support means for supporting one or more sheets supplied from image forming means; ejecting means for ejecting the one or more sheet supported by the support means; and stack means for stacking the one or more sheets ejected from the support means by the ejecting means; wherein the sheet processing device is further provided with auxiliary support means which is disposed on a forward end side in the sheet ejection direction of the support means and is rotated between a support position for supporting at least forward ends of the sheets and a retreating position for retreating from the support position.

Also, there can be provided the auxiliary support means which is disposed on the forward end side in the sheet ejection direction of the support means, and is capable of moving between the support position for supporting at least the forward end sides of the sheets and the retreating position for retreating from the supporting position; and transferring means which transfers the auxiliary support means from the retreating position to the support position in accordance with sheet size information, and transfers the auxiliary support means from the support position to the retreating position after predetermined post-processing of sheets is carried out.

Further, the device is provided with support means for supporting one or more sheets supplied from the image forming means; first ejecting means for contacting one surface of the one or more sheets supported by the support means; second ejecting means for contacting the other surfaces of the sheets; contacting-separating means for allowing the second ejecting means to contact and separate with respect to the other surface of the one or more sheets; and auxiliary support means which is disposed on the forward end side in the sheet ejection direction of the support means and is rotated between a support position for supporting at least the forward end part of the sheet and a retreating position for retreating from the support position; wherein common driving means controls timing for driving at least first ejecting means out of the first and second ejecting means, and for driving the contacting-separating means.

DETAILED DESCRIPTION OF PREFERRED EMBODIMENTS

Embodiments of the sheet processing device of the invention will be explained based on the drawings.

[The first embodiment]

Figure 1:
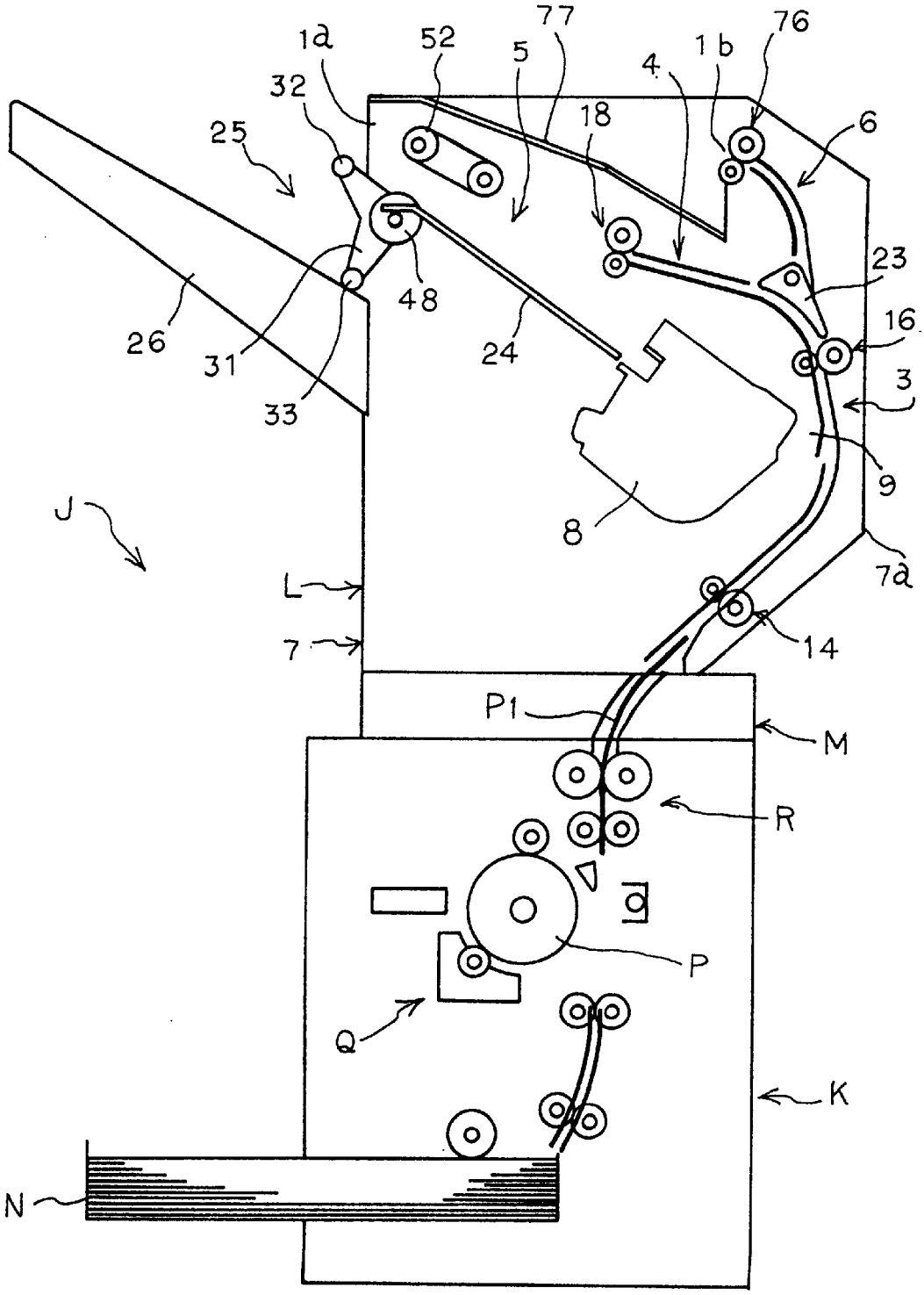
FIG. 1 is a schematic structure view showing a condition that a sheet processing device according to a first embodiment of the present invention is attached to an image forming device.

In FIG. 1, an image processing apparatus J is provided with an image forming device K such as a copier or a laser printer, a sheet processing device L disposed on the image forming device K, and an adapter device M for connecting the image forming device K and the sheet processing device L.

The image forming device K is provided with a paper supply cartridge N storing a plurality of sheets; image forming means Q including a transfer drum P for transferring an image to a sheet from the paper supply cartridge N; and a transfer part R for supplying the image-fixed sheet to the sheet processing device L; wherein a sheet P1 fed from the transfer part R is supplied to the sheet processing apparatus L through the adapter device M.

Incidentally, there may be formed an image processing apparatus wherein the image forming device K and the sheet processing device L are provided in one unit.

Figure 2:
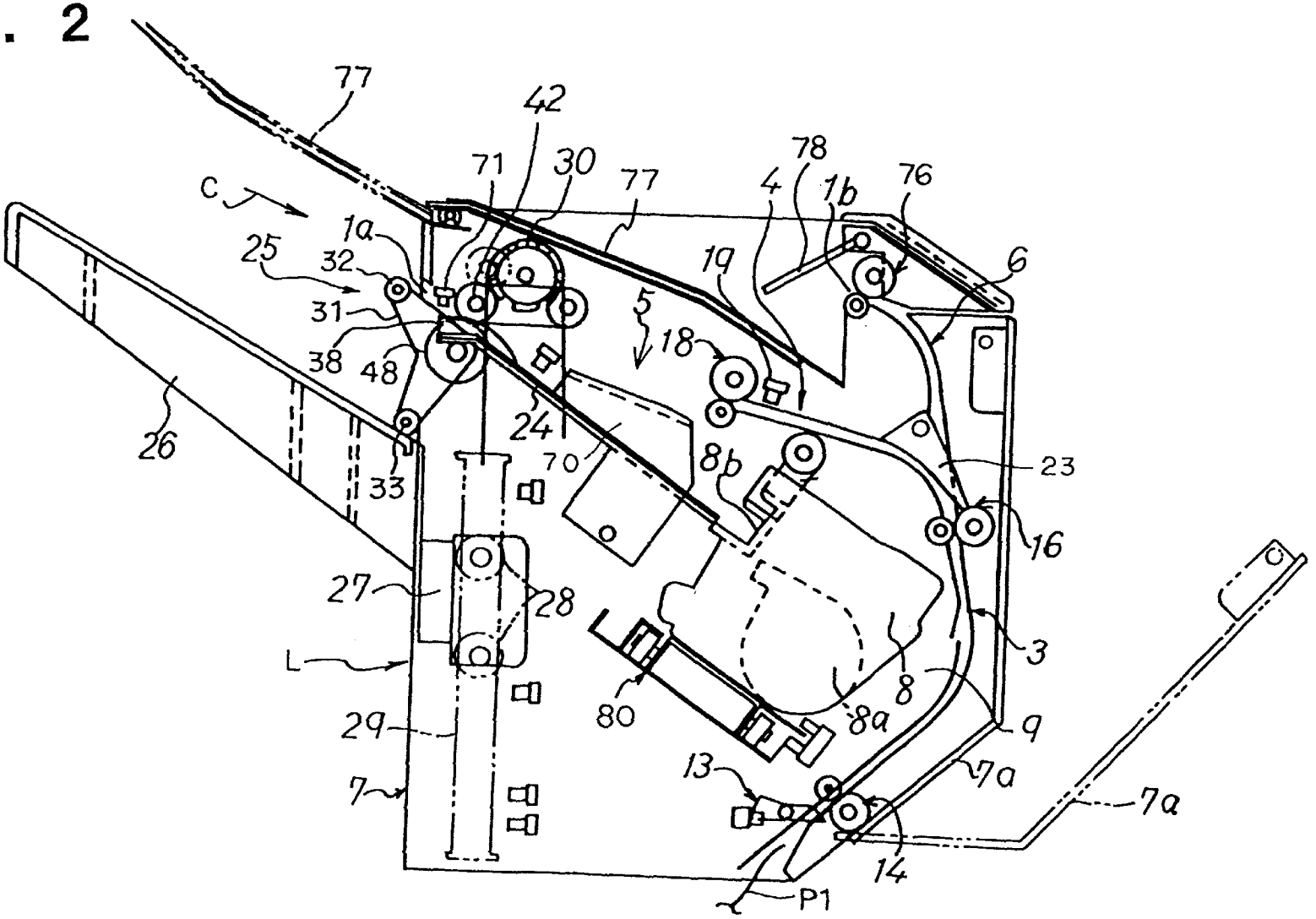
FIG. 2 is a sectional view showing an inner structure of the sheet processing device according to the present invention.

FIG. 2 shows a whole structure of the sheet processing device L of the invention. The sheet processing device L is provided with a sheet transfer path 3 leading the sheet P1 from the image forming device K upwardly; a first ejection path 4 for leading the sheet from the sheet transfer path 3 transversely; a processing space 5, which is formed between an exit end of the first ejection path 4 and an ejection outlet 1*a* and also used as an ejection path; and a second ejection path 6 for leading a sheet from the sheet transfer path 3 to an auxiliary stacking part 77.

Also, a whole path of the sheet transfer path 3 and the first ejection path 4 detours in the shape of C along a contour of rear part of a box member 7 of the sheet processing device L so as to form a storing space 9 for disposing post-processing means, for example, a stapler 8.

Further, the sheet transfer path 3 is provided with a sheet detecting sensor 13 for detecting leading end and rear end of the ejection direction of the sheet P1 sent from the image forming device K, a pair of supply rollers 14 for transferring the sheet P1, and a pair of transfer rollers 16.

In the first ejection path 4, there are disposed plural pairs of transfer rollers 18 for transferring the sheet sent from the sheet transfer path 3 to the downstream side of the ejection direction, and a sheet detecting sensor 19 for detecting the leading end and rear end of the ejection direction of the sheet in the first ejection path 4. Also, in a junction part of the first ejection path 4 and the second ejection path 6, there is disposed switching means 23 for switching the transferring direction of the sheet.

After the sheet detecting sensor 13 counts the number of copied sheets set at a control panel of the image forming device K or a computer side, when the sheet detecting sensor 19 detects the rear end of the ejection direction of the sheets corresponding to detection of count-up, a command signal for driving the stapler 8 is outputted after the predetermined time goes by.

In this embodiment, there is explained a case such that the sheet processing device L itself decides timing for staple processing based on information of the sheet detecting sensor 13 so as to drive the stapler 8; however, there may be a case wherein the image forming device K itself naturally knows the same timing, and counting the number of sheets and judging staple processing can be performed by the image forming device K so as to supply a staple processing command to the sheet processing device L. Further, a signal for actuating the stapler 8 may be generated by a hand push button.

The processing space 5 is located below the exit end of the first ejection path 4 and formed above supporting means, for example, a sheet holding part 24, slantingly extending toward the ejection outlet 1*a* from its lower end overlapping the exit end of the first ejection path 4. Also, in the vicinity of the ejection outlet 2*a* of the processing space 5, there is disposed an ejection processing section 25 for ejecting a set of sheets which are staple-processed at the sheet holding part 24.

Further, below the ejection processing section 25, there is disposed stacking means, for example, a stacking part 26 which inclines upwardly in the condition of projecting from an outer wall of the box member 7. A base of the stacking part 26 is fixed to a bracket 27, and when rollers 28 disposed in the bracket 27 move vertically along a guide rail 29, the stacking part 26 is able to ascend and descend. Incidentally, an elevating device 30 is provided outside the box member 7.

As shown in FIG. 3 through FIG. 6, the ejection processing section 25 is provided with a center gear 41; an input side gear 44 engaging a first gear portion 42 formed on a periphery of the center gear 41; an output side gear 45 engaging a second gear portion 43; first ejecting means, for example, an ejection roller 48 and a first mid gear 49 to which a rotational force of the output side gear 45 is transmitted by a pair of belts 46, 47 extending in different directions through pulleys 45*a*, 45*b* and a connecting shaft 55*a*; and contacting-separating means 50 to which a rotational force of the first mid gear 49 is further transmitted.

In the contacting-separating means 50, both ends of an arm portion 51 are provided with second ejecting means, for example, the ejection roller 52 being capable of separating from the ejection roller 48, and a second mid gear 53 engaging the first mid gear 49. At the same time, by connecting these ejection roller 52 and the mid gear 53 by the belt 54, a rotational force of the output side gear 45 is transmitted to the ejection roller 52.

Incidentally, the ejection roller 52 is located above the ejection roller 48, and is separated while it is being in contact with the ejection roller 48 through the rotation of moving the arm portion 51. Also, transmitting the rotational force to the ejection roller 48 and the first mid gear 49 is carried out through respective pulleys 48*a*, 49*a*, and further, transmitting the rotational force from the second mid gear 53 to the contacting-separating means 50 is carried out through respective pulleys 52*a*, 53*a*.

On the side of the second mid gear 53, there is disposed an engaging claw 56 projecting toward a side of the center gear 41 at an end of the arm portion 51, and the end of the arm portion 51 is urged upwardly by a coil spring 57.

On the other hand, on the side of the center gear 41, there is disposed an L-shaped lever 59 which is rotatable by a supporting shaft 58, and the engaging claw 56 is engaged with an engaging shaft 60 provided to project from one end of the L-shaped lever 59. Also, an eccentric cam 61 fixed to the center gear 41 abuts against the other end of the L-shaped lever 59, so that rotating position of the L-shaped lever 59 is controlled by rotation of the eccentric cam 61.

Incidentally, in the center gear 41, one end of a coil spring 62 urging the center gear 41 to a direction of rotation A is connected to an engaging pin 66, and a stopper pin 63 is projected in a vicinity thereof on the same surface. Then, an engaging piece 65 actuated by a solenoid 64 is engaged or disengaged with the stopper pin 63 so as to control the rotation of the center gear 41.

Also, notched holes 42*a*, 43*a* are formed at the first gear portion 42 and the second gear portion 43 of the center gear 41. Positions of the notched holes 42*a*, 43*a* correspond to the dispositions of the input side gear 44 and the output side gear 45, and while the stopper pin 63 engages the engaging piece 65, it is arranged that the rotation of the input side gear 44 is not transmitted to the output side gear 45. Incidentally, the input side gear 44 is always rotated through a driving shaft 44*a* by a driving motor, not shown.

Figure 6:
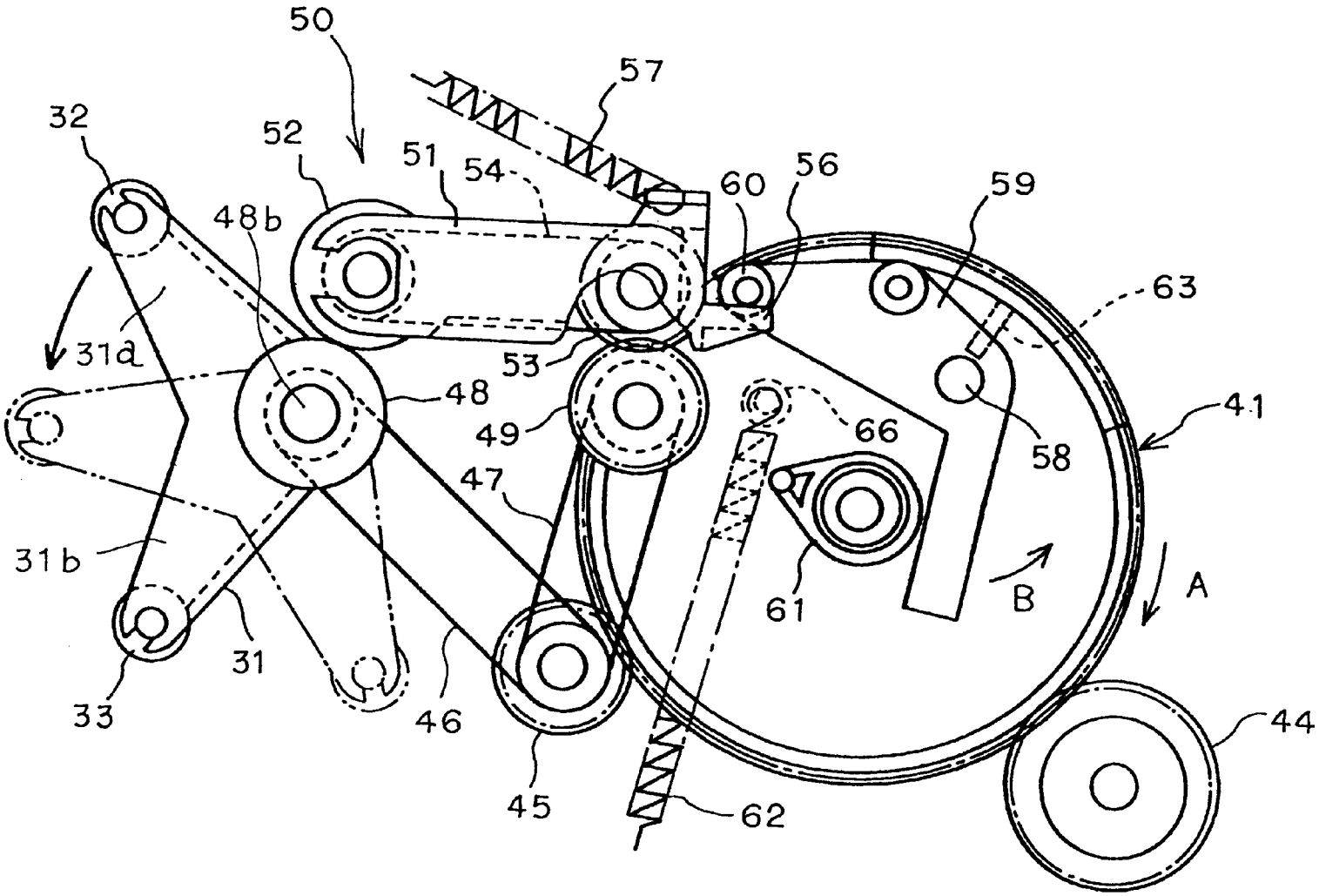
FIG. 6 is a schematic view showing a working condition of contacting-separating means in the invention.

Next, works of the ejection processing section 25 is explained. Firstly, the engaging piece 65 is sucked by electrifying the solenoid 64 shown in FIG. 4 for a predetermined period of time, and when engagement between the engaging piece 65 and the stopper pin 63 is released, the center gear 41 receives rotational force in the direction of the arrow A by action of the coil spring 62 shown in FIG. 3. Accordingly, the first gear portion 42 of the center gear 41 is engaged with the input side gear 44, and the center gear 41 begins to rotate through rotation input from the input side gear 44. The eccentric cam 61 rotates together with rotation of the center gear 41, and rotation control of the L-shaped lever 59 is released. As a result, the coil spring 57 at the arm portion 51 acts so that the engaging claw 56 provided at the end of the arm portion 51 pushes up the engaging shaft 60 of the L-shaped lever 59. The arm portion 51 rotates around the second mid gear 53 so as to allow the ejection roller 52 at a distal end thereof to contact with the ejection roller 48 as shown in FIG. 6.

On the other hand, in accordance with rotation of the center gear 41, the output side gear 45 engages the second gear portion 43 to rotate, and rotational force thereof is transmitted to the first mid gear 49 through the belts 46, 47. The rotational force transmitted to the first mid gear 49 is transmitted to the ejection roller 52 through the second mid gear 53 engaged therewith and the belt 54.

As described above, since the contacting-separating means 50 and the ejection rollers 48, 52 can be rotated together based on drive for rotating the input side gear 44, timing for driving the both can be easily adjusted. Also, 'since one driving source is sufficient, there is an enough space. Consequently, the ejection rollers 48 and the ejection roller 52 are rotated while abutting against each other so that these rollers can nip a set of sheets therebetween and send out the set of sheets in the ejection direction.

When the center gear 41 further rotates from the condition that the ejection rollers 48 contact with the ejection roller 52, the eccentric cam 61 makes one revolution to push the L-shaped lever 59 again. The L-shaped lever 59 rotates on the supporting shaft 58 in a direction of rotation B (FIG. 6), and the engaging shaft 60 pushes down the engaging claw 56 of the arm portion 51. Accordingly, the arm portion 51 rotates in a direction opposite to the aforementioned direction, the ejection roller 52 is separated from the ejection roller 48. Then, the center gear 41 makes one revolution so that the input side gear 44 is fitted with the notched hole 42*a* of the first gear portion 42 and the output side gear 45 is fitted with the notched hole 43*a* of the second gear portion 43, and at the same time, when the stopper pin 63 is engaged with the engaging piece 65 which has been returned by a spring 64*a* extending between the solenoid 64 and the stopper pin 63, the center gear 41 is stopped and returned to the original condition shown in FIG. 3. Thus, rotational force of the input side gear 44 is not transmitted to the center gear 41, so that driving for ascending and descending the contacting-separating means 50 and driving for rotating the ejection rollers 48, 52 are stopped.

Figure 3:
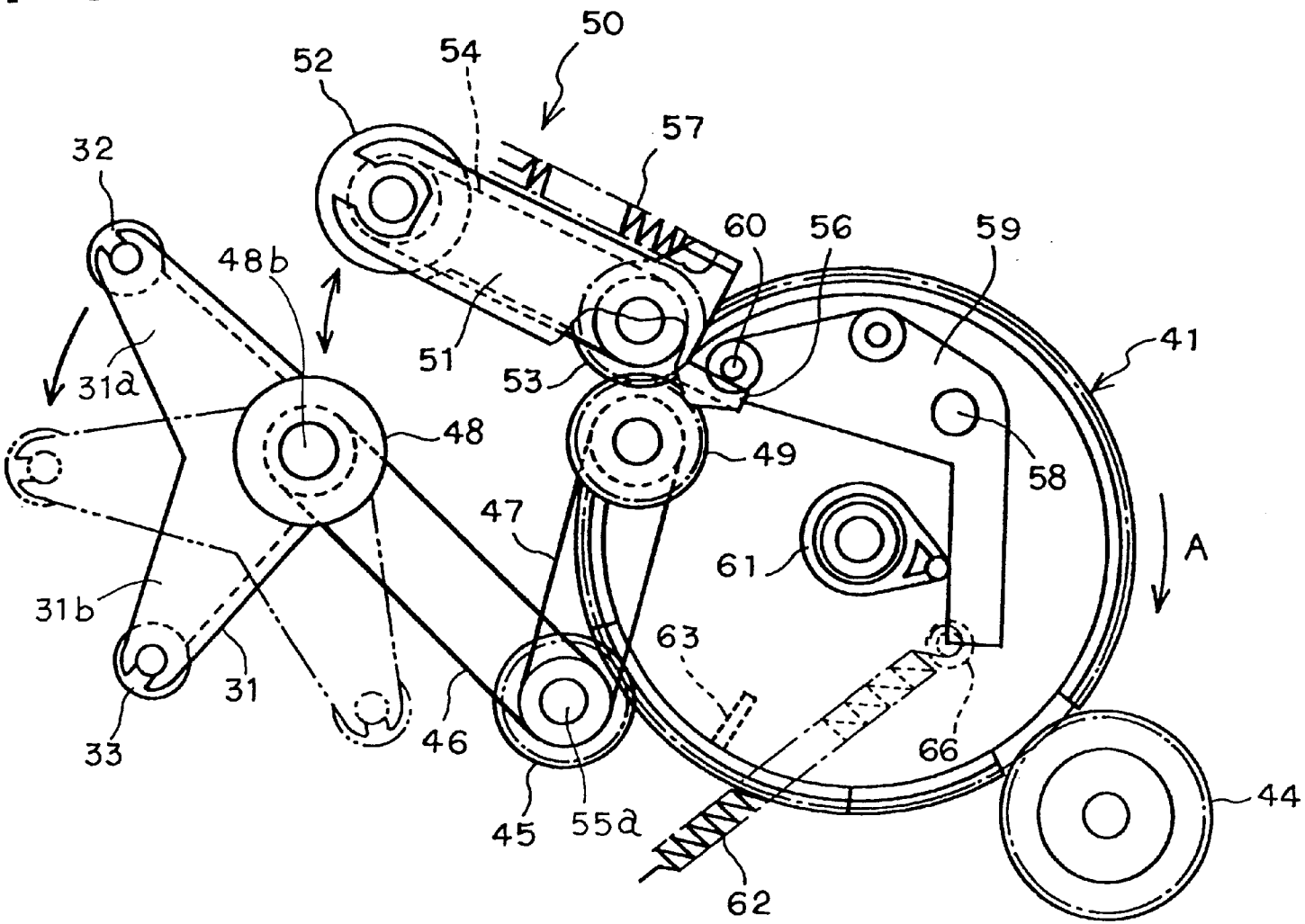
FIG. 3 is a schematic view showing a driving mechanism of an ejection processing section of the sheet processing device.
Figure 4:
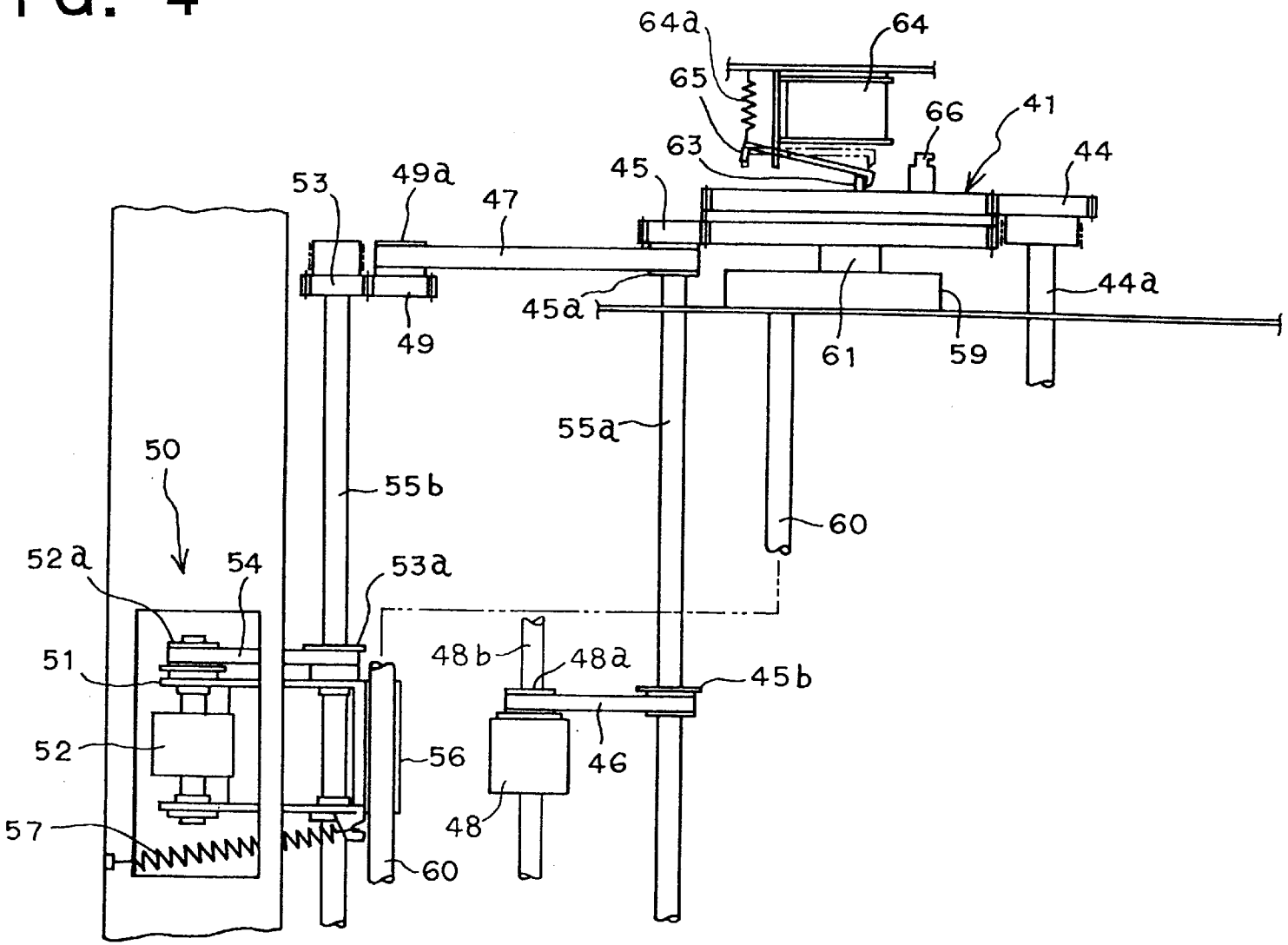
FIG. 4 is a plan view schematically showing drive transferring means of the ejection processing section shown in FIG. 3.
Figure 5:
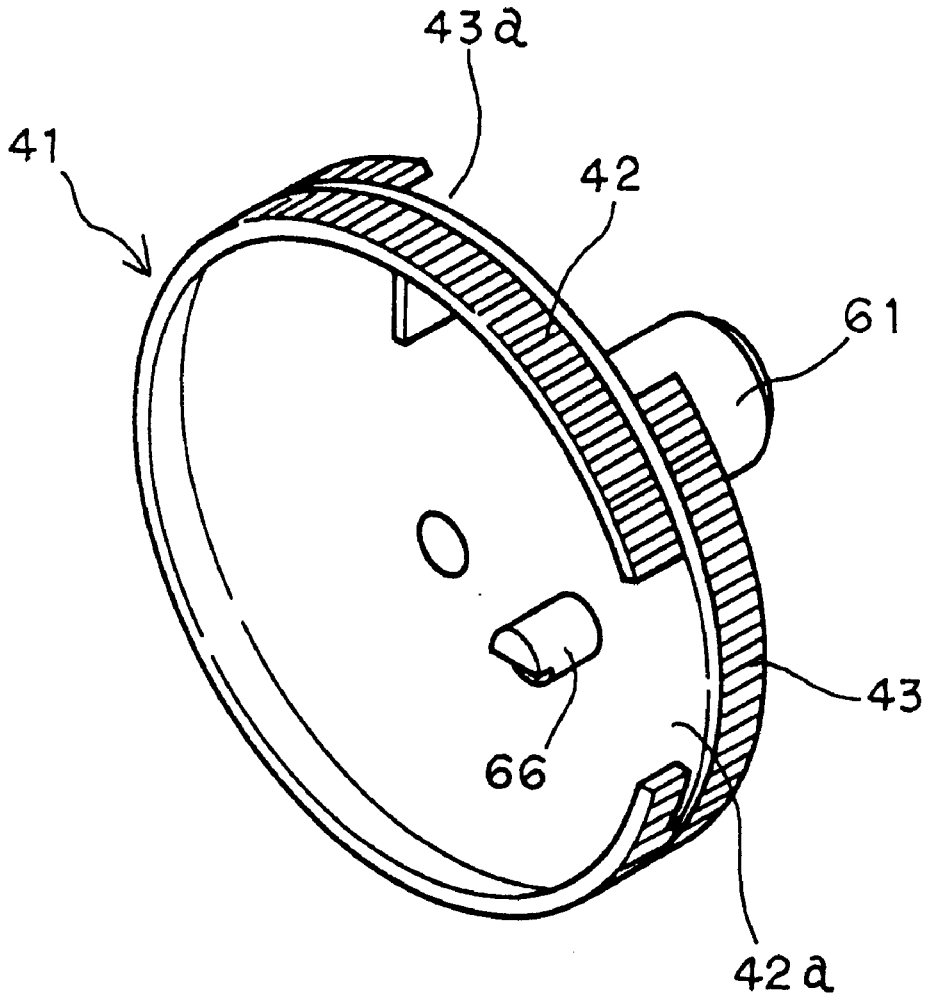
FIG. 5 is a perspective view showing a structure of a center gear.
Figure 7:
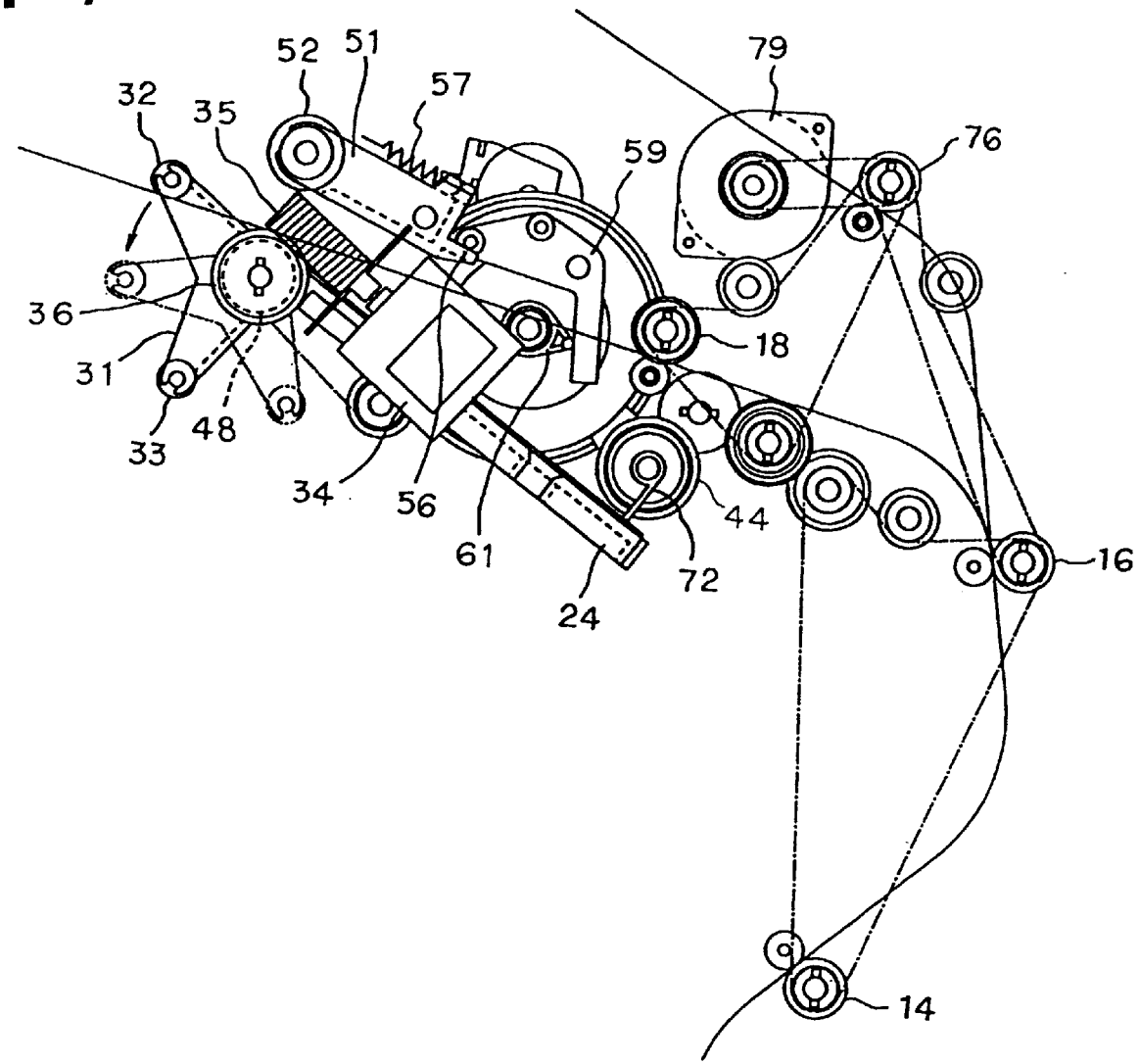
FIG. 7 is a schematic view showing a driving system for sheet transferring.

On the other hand, as shown in FIG. 3 and FIG. 7, auxiliary support means, for example, a substantially L-shaped rotation support member 31, which can vary an area for stacking sheets in cooperation with the sheet holding part 24, is attached to the rotation shaft 48*b* of the ejection roller 48. The rotation support member 31 includes at least two arms 31*a*, 31*b*, and the distal end thereof is provided with ejection encouragement means, for example, rollers 32, 33 to be rotatable. The rotation support member 31 is rotated by a worm gear 35 rotated by drive of a motor 34 which is different from driving means for the input side gear 44, and a rotation gear 36 rotated through rotation of the worm gear 35. Although the rotation gear 36 is disposed coaxially to the rotation shaft 48*b* of the ejection roller 48, they are independently rotated.

Figure 8:
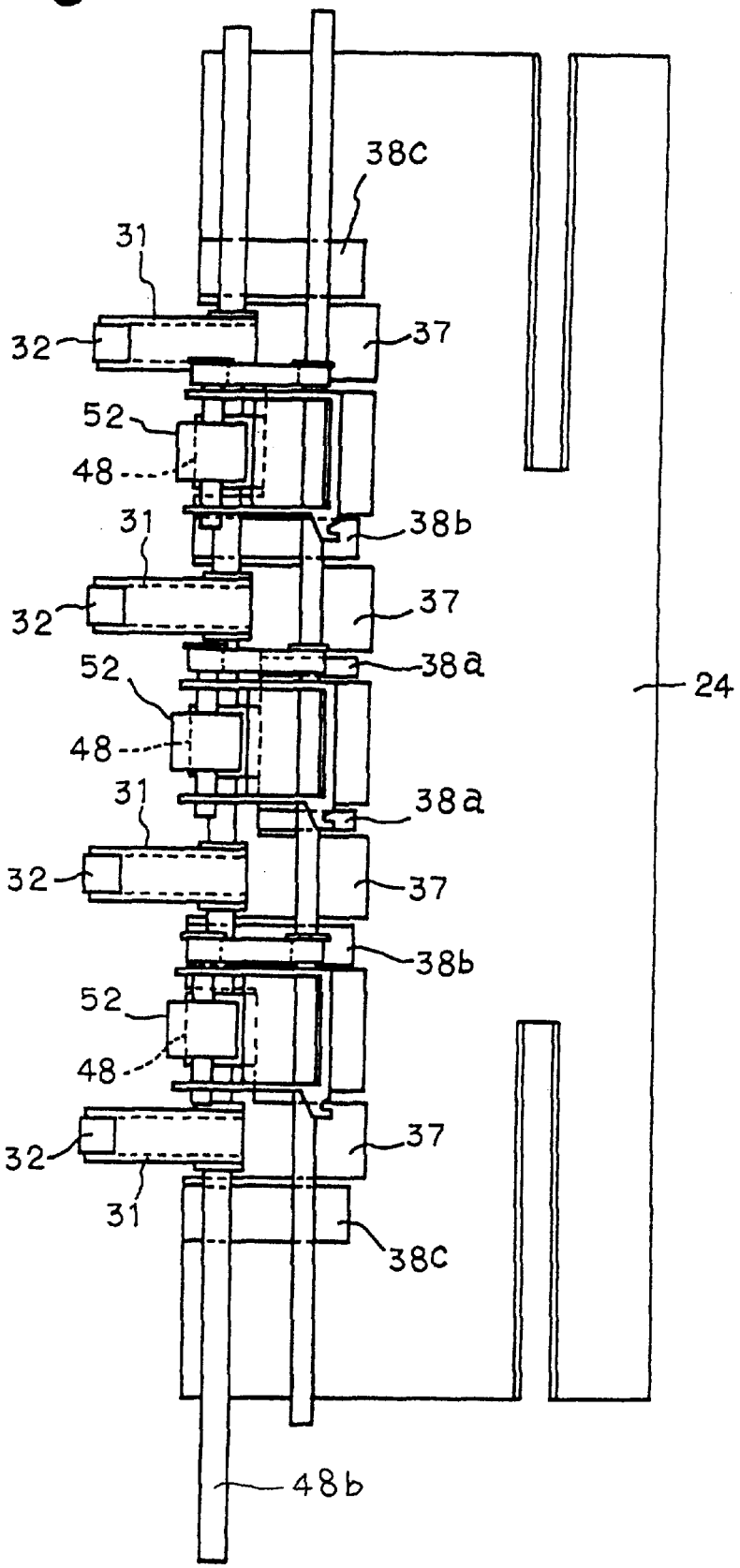
FIG. 8 is a plan view of an ejection roller and a rotation arm part in the ejection processing section shown in FIG. 2.
Figure 9:
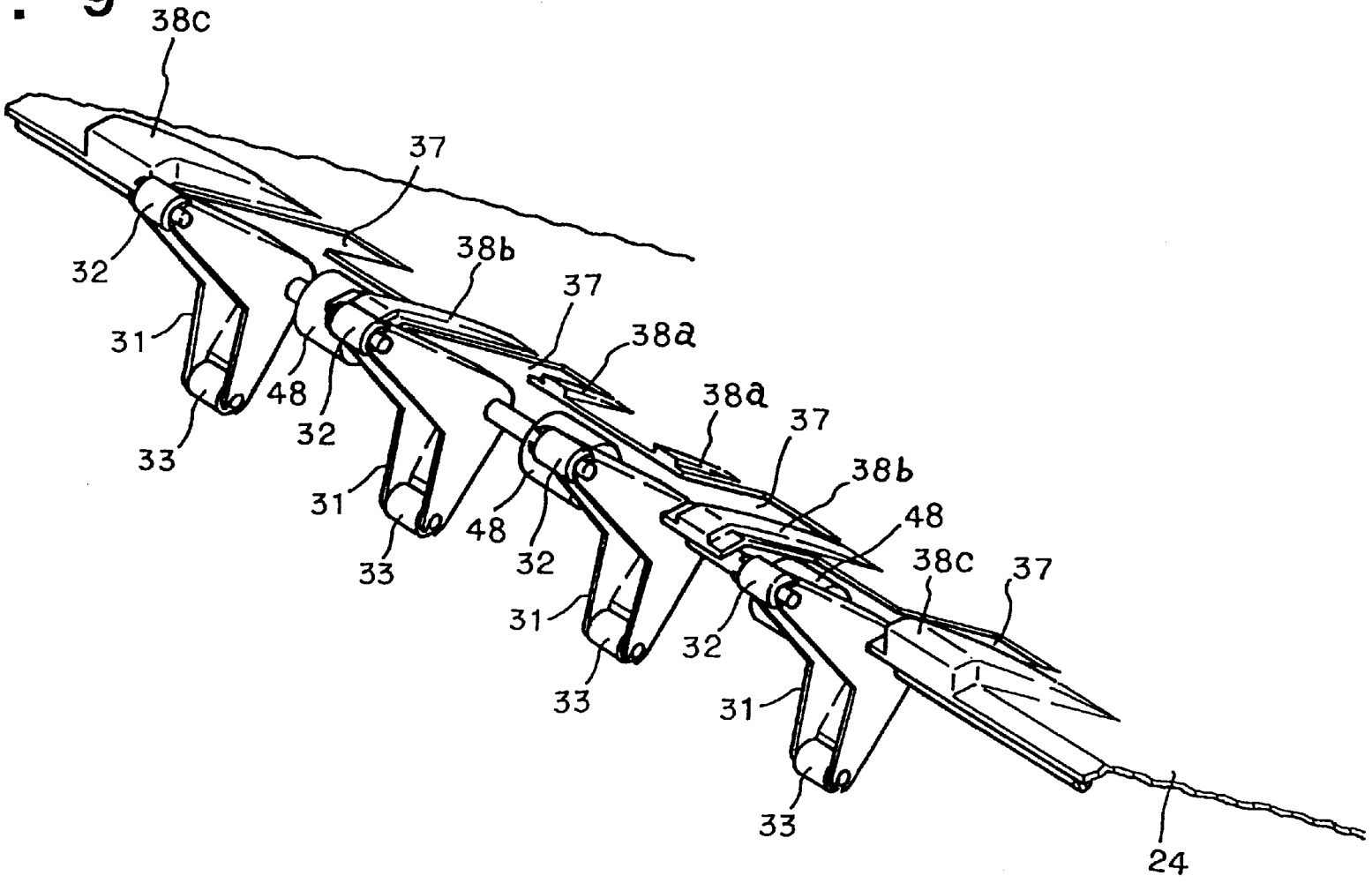
FIG. 9 is a perspective view of the ejection roller and the rotation arm part shown in FIG. 8.
Figure 10:
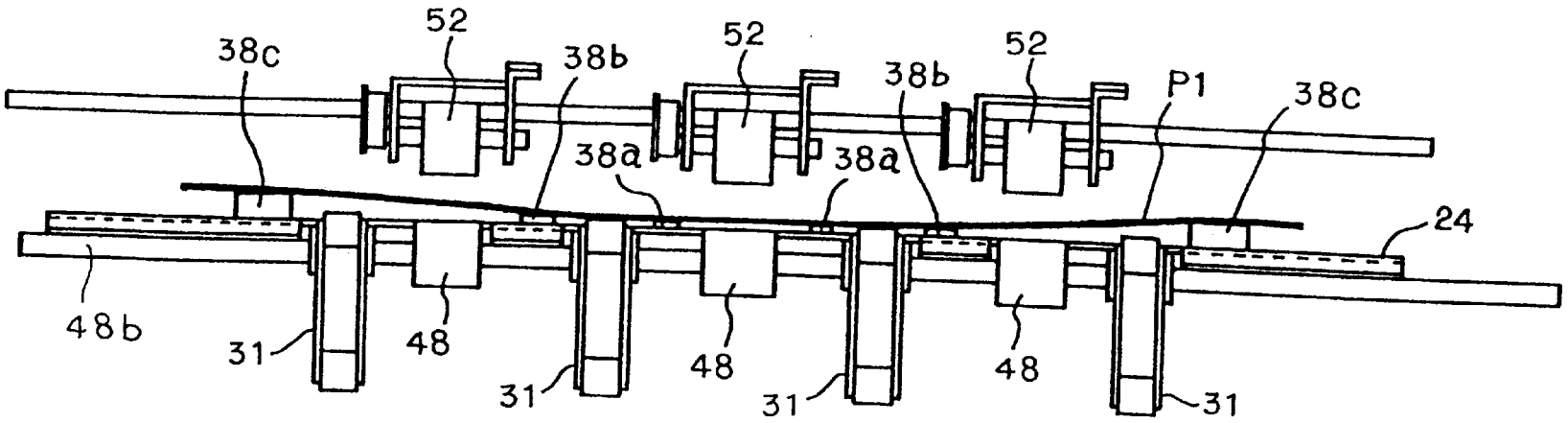
FIG. 10 is a view seen from a direction of an arrow C in FIG. 2, the view showing a positional relationship between a sheet, which is stacked on a sheet holding part, and the ejection roller.

Incidentally, as shown in FIG. 8 and FIG. 9, the aforementioned ejection rollers 48 and the rotation support member 31 are disposed adjacent to a plurality of rectangular notch portions 37 formed along an upper rim of the sheet holding part 24. Also, at the upper end of the sheet holding part 24, there are formed projection members 38 on respective side edges in the width direction of the notch portions 37. The projection member 38 is a resin molding which is formed integrally with the sheet holding part 24, and a front surface thereof is smooth and at the same time, forms a gently inclined surface toward the upper end of the sheet holding part 24. Also, the projection members 38 have different sizes in the width direction of the sheet holding part 24, such that shapes thereof are gradually increased in the order of projection members 38*a*, 38*a* in a central part, projection members 38*b*, 38*b* on both sides thereof, and projection members 38*c*, 38*c* on both sides thereof. This change in the shapes is to provide the sheet with stiffness by lifting both sides of the sheet in the width direction when the sheet is transferred from the sheet holding part 24 to the stacking part 26. Also, as shown in FIG. 10, any of the projection members 38*a*, 38*b*, and 38*c* is projected higher than the upper end position of the ejection roller 48.

Figure 13:
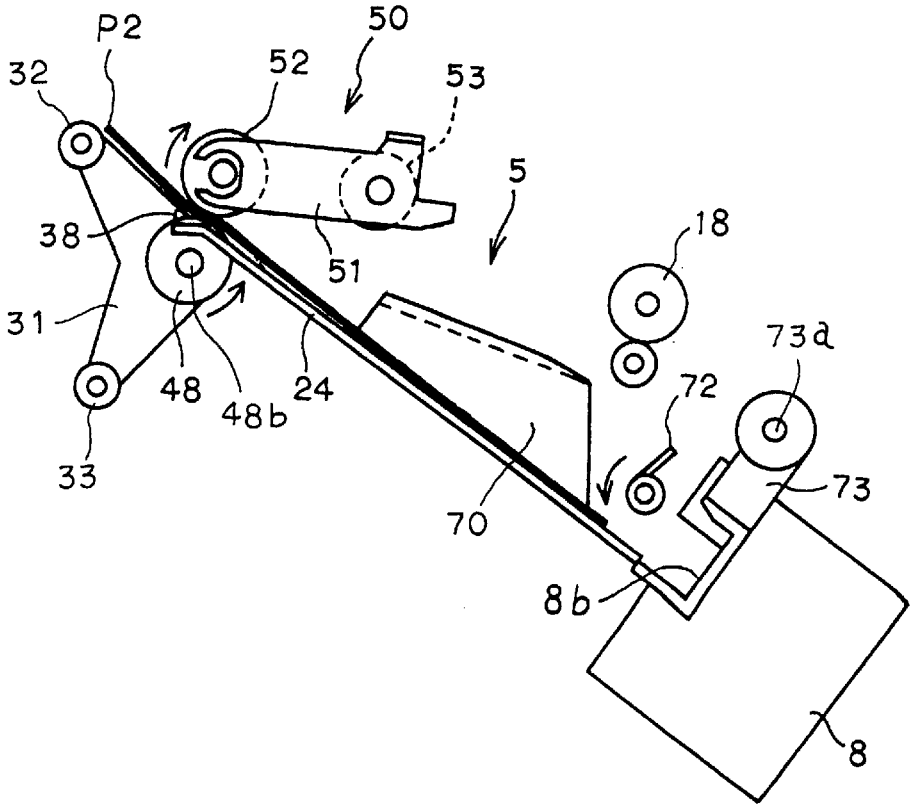
FIG. 13 is an explanatory view showing processes of ejecting sheets after stapling is finished.

Further, in this embodiment, as shown in FIG. 2, a pair of aligning plates 70 is disposed in the width direction of the sheet at the sheet holding part 24. The aligning plates 70 are provided to align both sides of sheets transferred from the first ejection path 4, and at least one of them is capable of changing a position in the width direction of the sheet according to the sheet size. Also, the stapler 8 is disposed in the storing space 9 formed by detouring the sheet transfer path 3 and the first ejection path 4 so as to be located between the lower end of the sheet holding part 24 and the sheet transfer path 3. Furthermore, a load detecting sensor 71 for detecting a load of sheets is disposed in the sheet holding part 24. In passing, the detected amount by the load detecting sensor 71 is set according to a stapling allowable amount of the stapler 8, and when sheets are stacked more than the stapling allowable amount, it is set not to staple any more. Also, as shown in FIG. 13, a paddle 72 is provided at the lower end of the sheet holding part 24.

The paddle 72 rotates (counterclockwise in FIG. 13) when it is confirmed that the predetermined time has passed after the sheet detecting sensor 19 detects passage of the sheet, so that sheets, which are ejected onto the sheet holding part 24 and slipped by its own weight toward the stapler 8 by this rotation, abut against a regulation wall 8*b* of the stapler 8 and a stopper 73 and are dropped to align the rear ends of the sheets.

As shown in FIG. 2, the final end of the second ejection path 6 is provided with a pair of ejection rollers 76 for ejecting the sheet from an auxiliary ejection port lb and a load detecting sensor 78 for detecting load of sheets collected in the auxiliary stacking part 77.

When the load detecting sensor 78 detects that load thereof reaches the maximum, the switching means 23 is activated to load the remaining sheets to the stacking part 26. Incidentally, loading sheets in case of not using the stapler 8 can be operated in the stacking part 26, and the auxiliary stacking part 77 may be used when loading sheets at the stacking part 26 reaches the maximum.

In passing, the sheet detecting sensor 19 and the load detecting sensor 71 also function as detecting sensors for sheet jam, and in case these sensors 19, 71 detect the sheet jam, the jam can be removed by opening the auxiliary stacking part 77 as shown by a single-dotted line in FIG. 2. Also, jam detection in the sheet transfer path 3 is operated by the sheet detecting sensor 13, and the jam can be removed by opening a rear cover 7*a* of the box member 7.

Incidentally, as shown in FIG. 2, the respective pairs of the rollers 14, 16, 18, 76 are structured such that one of the rollers is a driving side roller and the other is a driven side roller, and driving of a motor 79 in FIG. 7 rotates a pair of rollers 76 and also rotates driving side rollers of the respective pairs of the rollers 14, 16, 18 through a plurality of pulleys and belts.

On the other hand, as shown in FIG. 2, in order to enable to staple the width and the staple position of the sheets, or to staple plural points, the stapler 8 is movable in the width direction of the sheet by a moving apparatus 80. Also, the rear end of the sheet in the ejection direction abuts against the regulation wall 8*b* of the stapler 8 and the stopper 73 so as to align; however, since the staple positions of the sheet exist plurally, the following are elaborated.

Namely, the stoppers 73 are disposed at two points in the axial direction and rotate in accordance with rotation of a shaft 73*a*; however, since the stopper 73 is engaged by a coil spring with respect to the shaft 73*a*, in case the stopper 73 hits the stapler 8 when the shaft 73*a* rotates, the coil spring is defeated to stop rotation of the stopper 73, and on the other hand, the stopper 8 which does not hit is rotated together with the shaft 73*a* to standby in the aligning position. By the aforementioned structure, it is possible to properly align the rear end of the sheet even when standing by at any positions for operating a staple process.

Incidentally, a cartridge 8*a* built in the stapler 8 can be exchanged by opening the rear cover 7*a* of the box member 7, and therefore, the sheet transfer path 3 is opened at the center thereof.

The aforementioned sheet holding part 24, the stacking part 26, and the auxiliary stacking part 77 are structured to have at least one part inclined upwardly such that the rear end of the sheet ejection direction is located below the forward end thereof so as to align the rear end by its own weight.

Next, there is explained a case in which a set of the sheets is stapled by the stapler 8 in the sheet processing device L formed of the above structure.

Figure 14A:
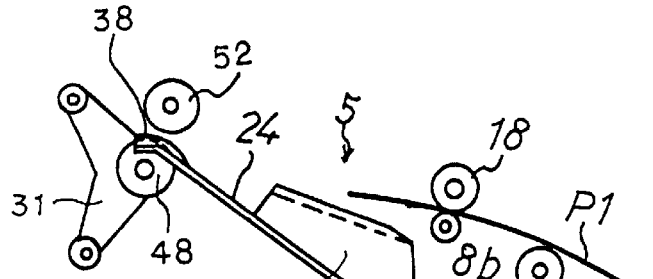
FIG. 14A through FIG. 14D are explanatory views showing processes of collecting sheets to the sheet holding part in time series.

Firstly, the sheet P1 ejected from the image forming device K is transferred by driving the pairs of the transfer rollers 14, 16, 18, through the sheet transfer path 3 and the first ejection path 4 as if it were detouring. Then, as shown in FIG. 14A, the sheet P1 is sent to the processing space 5 from a pair of the transfer rollers 18 disposed in the final end of the first ejection path 4. At this time, the ejection rollers 52 of the contacting-separating means 50 are located to be away from the ejection rollers 48.

Figure 14B:
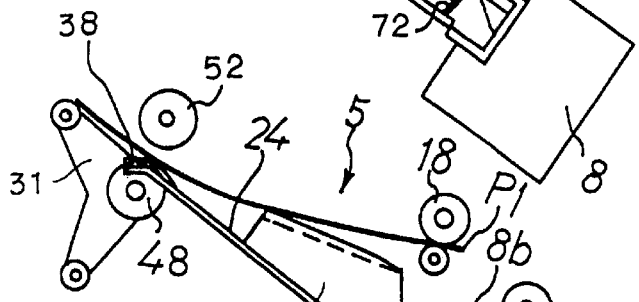

The sheet P1 sent from the processing space 5 to the sheet holding part 24, as shown in FIG. 14B, extends to the position projected from the upper end of the sheet holding part 24 with lower surface of the sheet which does not contact with the ejection rollers 48 since the sheet is ejected while the forward end of the ejection direction is contacting with the projection members 38 at the upper end of the sheet holding part 24.

Figure 12:
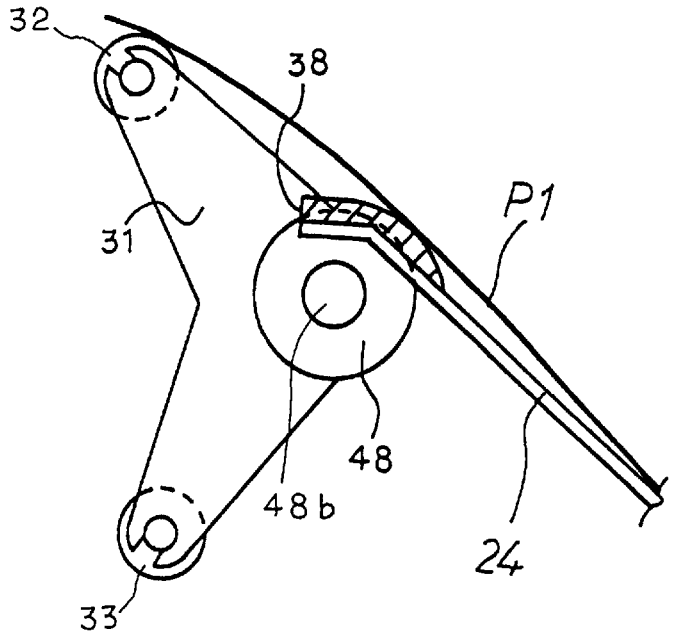
FIG. 12 is a magnified view of a part D in FIG. 14C.
Figure 14C:
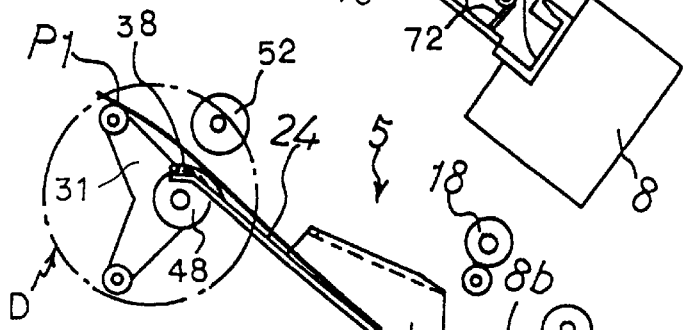

Further, as shown in FIG. 14C, when the rear end in the ejection direction of the sheet P1 is taken out from the pair of the transfer rollers 18, the sheet P1 is stacked on the sheet holding part 24 in the condition that the forward end in the ejection direction of the sheet is projected from the upper end of the sheet holding part 24. Since the sheet holding part 24 is inclined downwardly to a side of the stapler 8, the sheet is slipped on the sheet holding part 24 by its own weight. At this time, as shown in FIG. 12, since the forward end in the ejection direction of the sheet P1 does not contact with the rubber-formed ejection rollers 48 but instead slides down along inclined surfaces of the projection members 38 which have much smaller coefficient of friction than that of the ejection rollers, sliding at the forward end is good and the sheet P1 smoothly slides down on the sheet holding part 24.

Figure 14D:
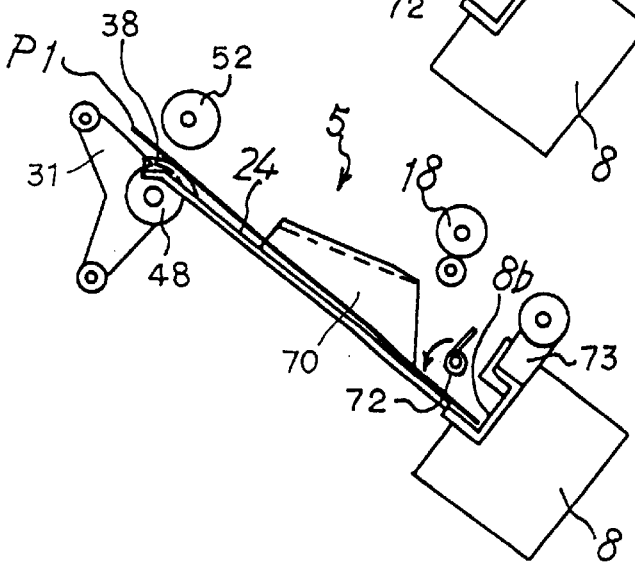

The sheet P1 slid down by its own weight on the sheet holding part 24 is, as shown in FIG. 14D, aligned such that both ends in the width direction of the sheet P1 are aligned by a pair of the aligning plates 70 and the rear end in the ejection direction of the sheet P1 is aligned by abutting against the stopper 73 and the regulation wall 8*b* of the stapler 8 by rotation of the paddle 72. As described above, the sheet P1 is aligned at the staple position sheet by sheet and the sheet detecting sensor 13 counts the is predetermined number of sheets, and when the sheet detecting sensor 19 detects, in the predetermined time, that the final sheet for count-up is transferred to the sheet holding part 24 and aligning is finished, the paddle 72 rotates and drops the final sheet to the stapler 8. Thereafter, a set of the sheets is stapled at the stapler 8. At this time, since an image forming face of the sheet faces the side of the sheet holding part 24 (according to the ejection condition by the image forming device), the stapler 8 operates stapling from the lower side thereof.

Figure 11:
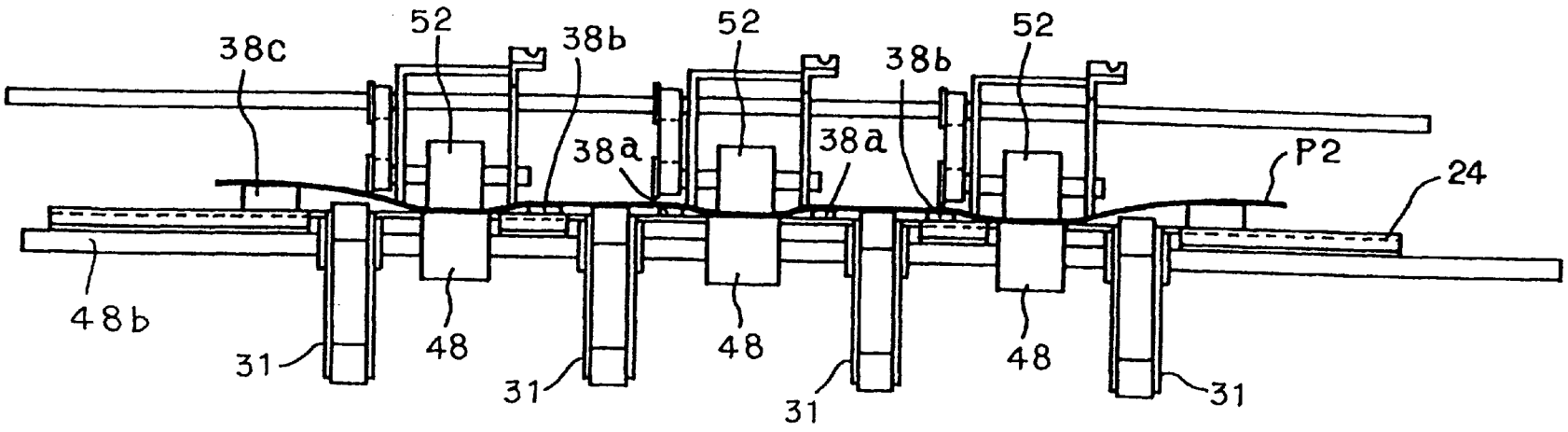
FIG. 11 is a view seen from the arrow C in FIG. 2, the view showing works of projection members at the time of ejecting sheets.

Next, based on FIG. 11 and FIG. 13, there is explained a case wherein the stapled set of the sheets is transferred to the stacking part 26. By rotation of the center gear 41, the arm portion 51 of the contacting-separating means 50 has already been rotated to the side of the ejection roller 48 at the time of activation for the above described stapling, and allows the ejection roller 52 to abut against an upper face of a set of sheets P2 to nip the set of sheets P2 between the ejection roller 52 and the ejection roller 48. At this time, as shown in FIG. 11, on just both sides of the rollers 48, 52, difference in level is made in the set of the sheets P2 by means of the projection members 38*a*, 38*b*, 38*c* to provide stiffness to the sheet. Especially, since the difference in level on the side of the outside projection member 38*c* is higher, the both sides of the sheet are largely protruded.

As described above, by giving a plurality of steps in the set of sheets P2, when both the ejection rollers 48, 52 rotate to transfer the set of the sheet to the stacking part 26 while nipping the set of sheets P2 therebetween, since the set of the sheets P2 is transferred on the stacking part 26 in the condition that the set of the sheets P2 has stiffness at the step portions, the forward end in the ejection direction of the set of the sheets P2 is prevented from drooping, and becomes hard to contact with the stacking part 26. As a result, transfer resistance of the set of the sheets P2 in the stacking part 26 is lessened and the sheet is smoothly stored in the stacking part 26, so that ability for aligning the set of the sheets P2 is improved. Especially, in case the number of the sheets to be stapled in the set of the sheets P2 is small, the effect is remarkable. As described above, the process according to the number of sets of the sheets P2 is repeated, when the load of the set of the sheets P2 is increased, the stacking part 26 is moved downwardly, and a large amount of sets of sheets P2 can be stacked.

At the time of stapling, since the ejection rollers 52 already approach the ejection rollers 48 so as to grip the set of the sheets, there is no chance of putting the set of the sheets into disorder by the stapling process.

The stopper 73 is rotatable by the shaft 73*a* as shown in FIG. 13; however, since the stopper 73 is engaged with the shaft 73*a* by the coil spring, when the stopper 73 rotates to abut against the upper surface of the stapler 8, the coil spring is defeated and the stopper 73 is engaged to stop. The stoppers 73 are disposed to the shaft 73*a* at the two points, and it is structured that wherever the stapler 8 stops, the rear end can be supported by at least one stopper 73 and the staple regulation wall 8*b*.

Figure 15A:
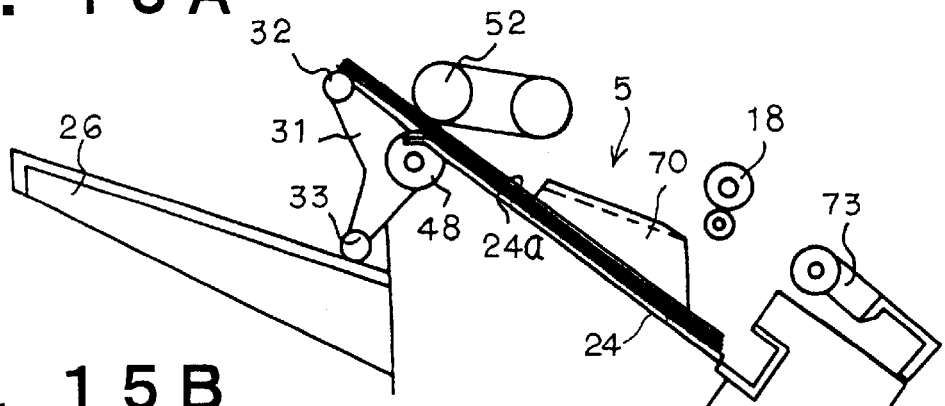
FIG. 15A through FIG. 15D are explanatory views showing, in time series, processes of transferring a set of sheets to a stacking part.
Figure 15B:
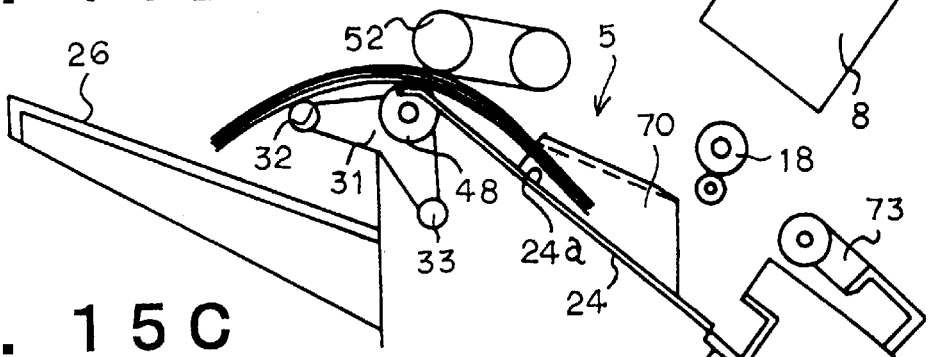
Figure 15C:
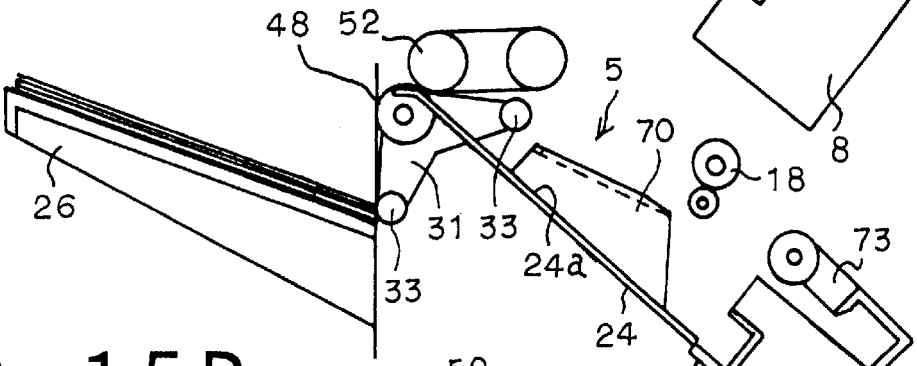

Further, as shown in FIG. 15B, the set of the sheets after being stapled is transferred by cooperation of the ejection roller 48 and the ejection roller 52. At this time, the rotation support member 31 is simultaneously rotated to release the extended condition of a loading surface 24*a*, and loads the set of the sheets on the stacking part 26 as shown in FIG. 15C.

Figure 15D:
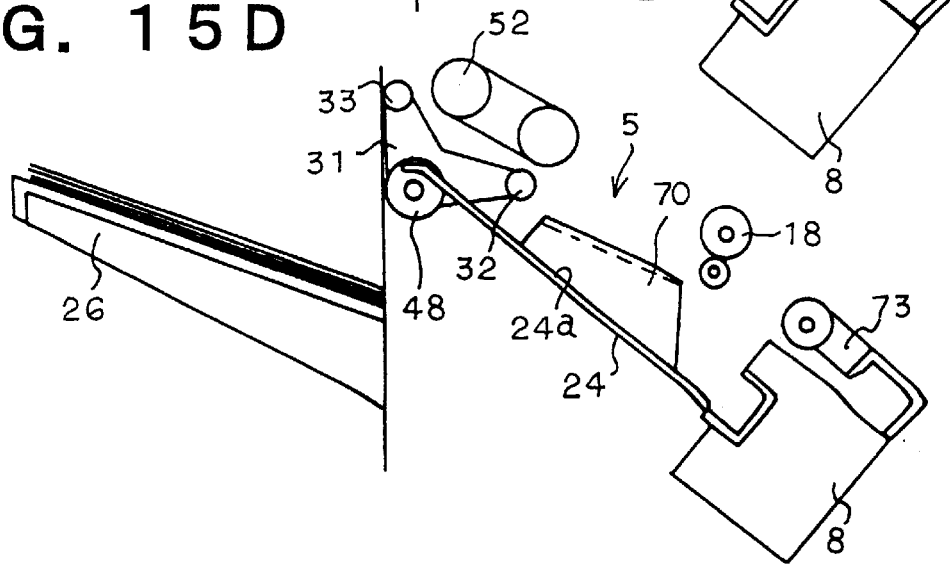

Further, he rotation support member 31 keeps rotating so as to return to the extended condition of the original loading surface 26*a* as shown in FIG. 15D, and rotation is stopped in the returned condition. Thereinafter, the process according to the number of sets of the sheets is repeated, and when the load of the set of the sheets is increased, the stacking part 26 is moved downwardly so as to enable stacking a large amount of the set of sheets.

On the other hand, when stapling is not operated, the switching means 23 allows the second ejection path 6 to communicate with the sheet transfer path 3.

The sheet ejected from the image forming device K is transferred by the transfer rollers 14, 16, 76, by way of the sheet transfer path 3 and the second ejection path 6, to be successively stacked onto the auxiliary stacking part 77.

Figure 16A:
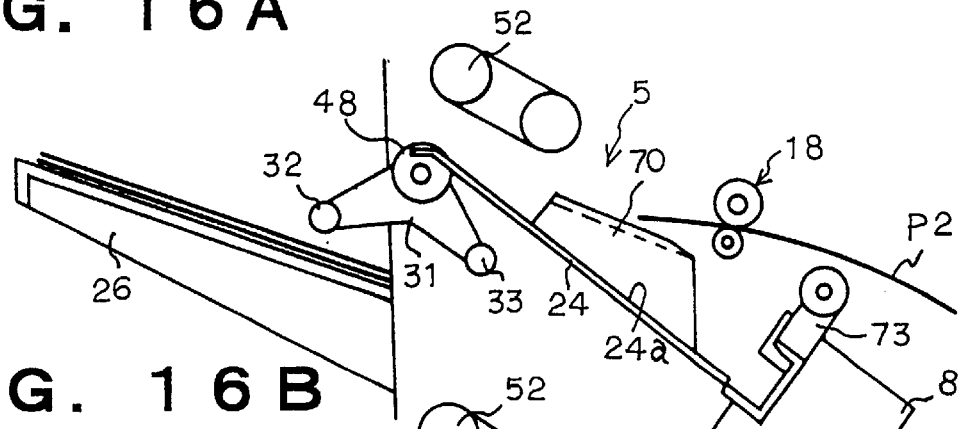
FIG. 16A through FIG. 16D are explanatory views showing, in time series, processes of directly transferring a sheet to the stacking part.
Figure 16B:
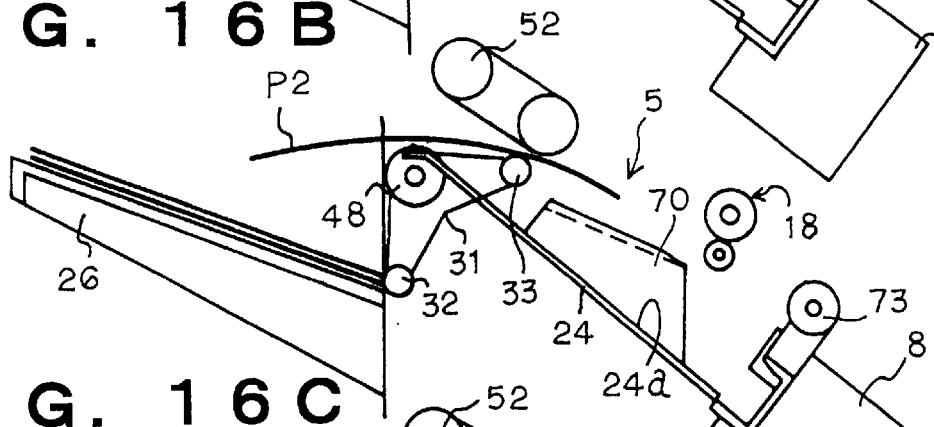
Figure 16C:
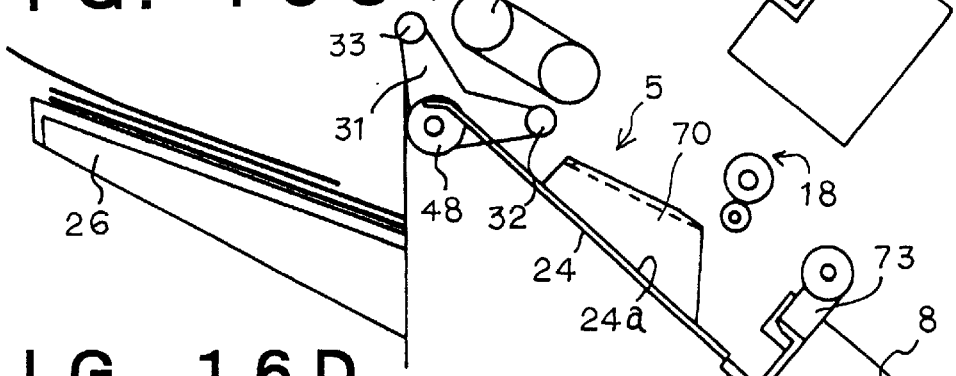

Further, in case sheets are fully loaded in the auxiliary stacking part 77, or in case the sheets are successively loaded in the stacking part 26 without using the auxiliary stacking part 77, as shown in FIG. 16A, the ejection roller 52 is spaced away from the ejection roller 48, and at the same time, the rotation support member 31 releases the extended condition of the loading surface 24*a*. As shown in FIG. 16B, the rotation support member 31 is rotated in the predetermined timing (detecting passing of the sheet by the sensor 19), and as shown in FIG. 16C, the both ends thereof transfer the sheet to the stacking part 26 as if carrying the sheet.

Figure 16D:
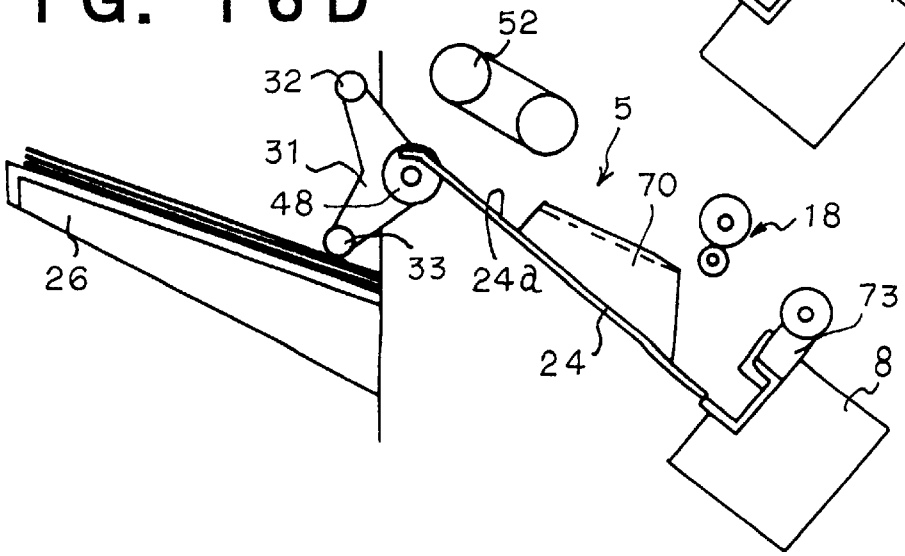

Moreover, after the sheet is transferred to the stacking part 26, as shown in FIG. 16D, the roller 33 with low frictional resistance contacts with a sheet located uppermost in the stacking part 26, namely, an upper surface of the sheet transferred just before, and by further rotational force of the rotation support member 31, the end of the sheet on the transfer downstream side is contacted with the box member 7 or the like to align the sheet.

As described above, by providing the rotation support member 31 which is located at the forward end side in the ejection direction of the sheet holding part 24 and which temporarily allows the loading surface 24*a* to extend from the ejection roller 48 in the ejection direction, in case sheets are temporarily stacked on the sheet holding part 24, the stacking surface 24*a* becomes capable of stacking the sheets in the certain and stable condition; in case of stacking the set of the sheets from the sheet holding part 24 to the stacking part 26, rotation of the rotation support member 31 in the ejection direction shortens the stacking surface 24*a* of the ejection direction, and moreover, sending out can be operated by the rotation in the ejection direction, so that ejecting the set of the temporarily loaded sheets to the stacking part 26 can be carried out easily and orderly.

Also, compared to the case that the sheet is transferred into the sheet holding part 24, when sheet drops by its own weight in accordance with the inclination of the sheet holding part 24, an angle of inclination of the rotation support member 31 (an angle formed with the stacking surface 24*a*) is widened, and furthermore, the rotation support member 31 is swung according to dropping of the sheet by its own weight to repeat contacting and separating with respect to the sheet, so that dropping of the sheet by its own weight to the lower end side of the sheet holding part 24 can be encouraged.

When the size of the sheet is different, or when the quality or the thickness of the sheet is different, stiffness thereof becomes different, so that a set angle of the rotation support member 31 can be made different to provide an adequate urging force for dropping the sheet by its own weight. Also, the rotation support member 31 releases extension of the stacking surface 24*a* at the time of ejecting the sheet, and rotates to kick the middle part of the sheet to eject as shown in FIG. 15C and FIG. 16B, so that ejecting the sheet to the stacking part 26 is facilitated.

Then, in the ejecting condition, by releasing extension of the stacking surface 24*a* and retreating the rotation support member 31 from the upper part of the stacking part 26, there can be solved inconvenience that when the rear end of the set of the sheets is escaped from the ejection roller 48 and dropped onto the stacking part 26, the rear end is caught by a staple needle of the already stacked set of the sheets to prevent alignment.

Also, by providing the rollers 32, 33 at both ends of the rotation support member 31 for reducing frictional resistance, there can be prevented inconvenience beforehand such that the sheet is caught, or only the lowermost sheet is caught during rotation ejection action so as to cause displacement.

Further, since the rotation support member 31 has a substantially L-shape in which distances from a rotation center are equal, the same extension or sending-out effect can be expected at either end portion, and moreover contacting the lowermost sheet at the earlier stage is available, so that displacement of the set of the sheets can be prevented ahead of time. This shape is, however, not limited to the substantial L shape, and may be a hub shape having a plurality of arms or a substantial fan shape.

Also, since one end of the rotation support member 31 abuts against the sheet loaded on the stacking part 26 under the condition that the stacking surface 24*a* is extended by the other end of the rotation support member 31, the rotation support member 31 can be also used as a holding member for the sheets stacked on the stacking part 26. At this time, since frictional resistance is reduced by providing the rollers 32, 33, there is no incidence such that the uppermost sheet is damaged or the sheet is caught in the rotation direction of the rotation support member 31 while the rotation support member 31 is rotating.

Furthermore, since the rotation support member 31 can be used as the holding member for the sheets in the stacking part 26, it can be also applied to the structure such that a driving part of the stacking part 26 is urged upwardly by, for example, the spring. Especially, in this structure, it is preferable that rotational auxiliary support means has a perfect fan shape and outer periphery of rotation is uniform so that the distal end or the largest outer periphery of the arm can keep holding until retreating from the stacking part 26. Naturally, it is preferable to have rollers adjacent thereto.

It has important meaning with respect to performance that if the rotation support member 31 as an auxiliary tray is not flush with a portion of the sheet holding part 24 contacting the rotation support member 31 at the edge thereof, transferring the sheet to the sheet holding part 24 or dropping by its own weight are affected, so that imperfect staple process and inferior aligning are induced. Thus, a surface expanding from a base, which fixes the rotation shaft of the rotation support member 31, to the arm is formed substantially the same height as the distal end surface of the sheet holding part 24.

To achieve this, the rotation shaft of the rotation support member 31 is made the same as the rotation shaft of the ejection roller 48, and the ejection roller 48 is freely supported with respect to the shaft to be driven externally. Accordingly, a structure which rarely causes failure of transferring can be obtained.

From the above point of view, in the vicinity of the sheet holding part 24, there is disposed the detecting sensor 71 for detecting that the sheet loaded on the stacking surface 24*a* is not ejected to the stacking part 26, for example, when the sheet is not ejected from the sheet holding part 24 within the predetermined time, it is decided that the set of the sheets temporarily stacked on the sheet holding part 24 fails to be ejected due to slip of the pair of the ejection rollers 25 or the like, so that it can be controlled that the rotation support member 31 is swung to promote ejection, or after the predetermined time from detecting passage of the forward end of the sheet, the rotation support member 31 is rotated so as to spring up the sheet in the ejecting process.

Therefore, it is preferable that the detecting sensor 71 is disposed at a position wherein when the size of the sheet stacked on the sheet holding part 24 is the largest, the sheet is not detected.

Also, the rotation support member 31 can process corresponding to the sizes by differentiating the rotation angle speed according to the size of the sheet loaded on the sheet holding part 24.

As described above, in the sheet processing device of this embodiment, by providing rotational auxiliary support means which is located at the distal end in the ejection direction of the sheet holding part 24, and temporarily extends the stacking surface to the ejection direction further than the ejection roller, the stacking surface of the sheet holding part 24 can be varied in accordance with the condition thereof, and moreover, ejecting the set of sheets temporarily stacked on the stacking part 26 can be operated easily and orderly.

(A modified example 1 of the ejection processing section 25)

Figure 17:
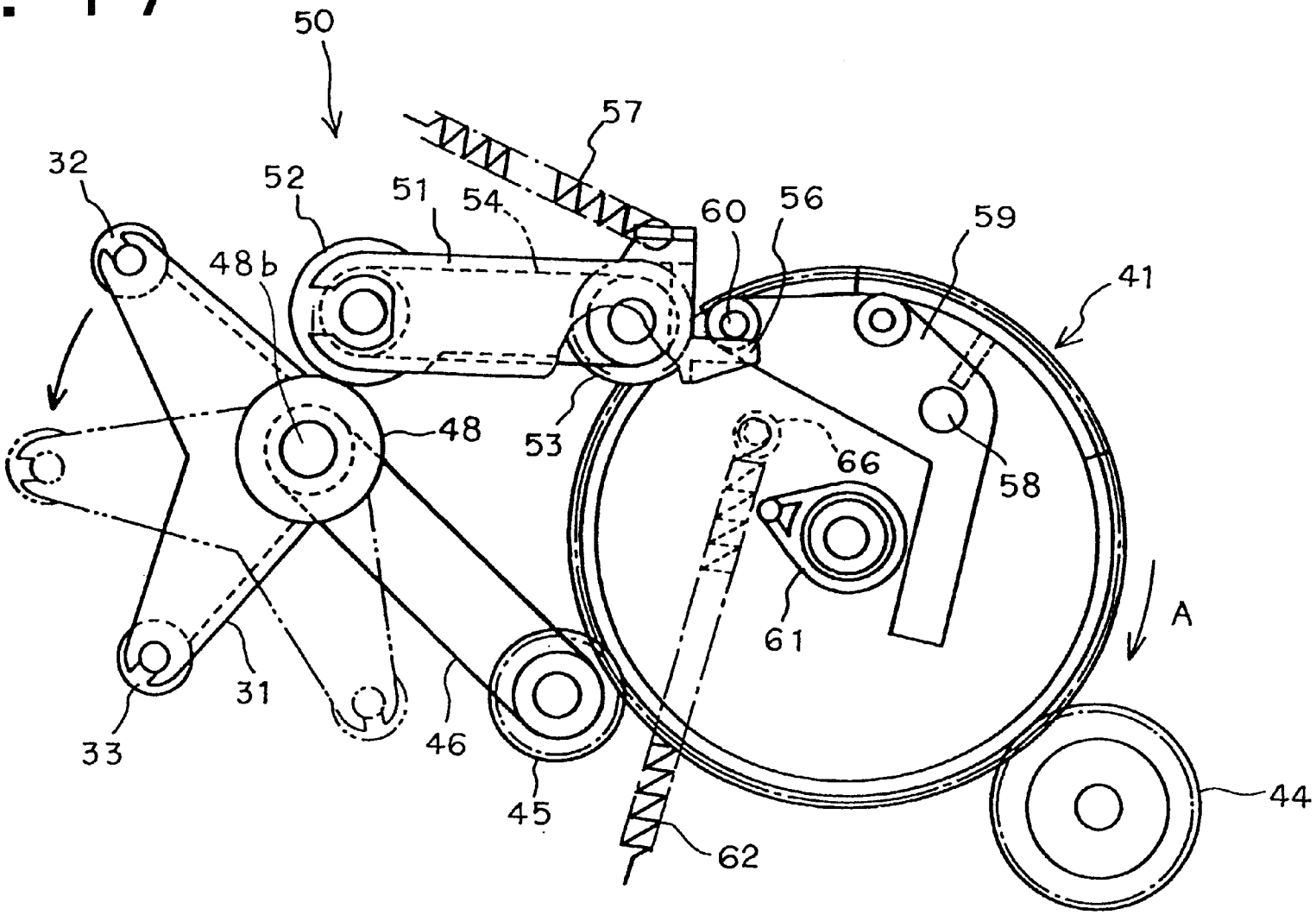
FIG. 17 is a schematic view showing a modified example of the ejection processing section.
Figure 18:
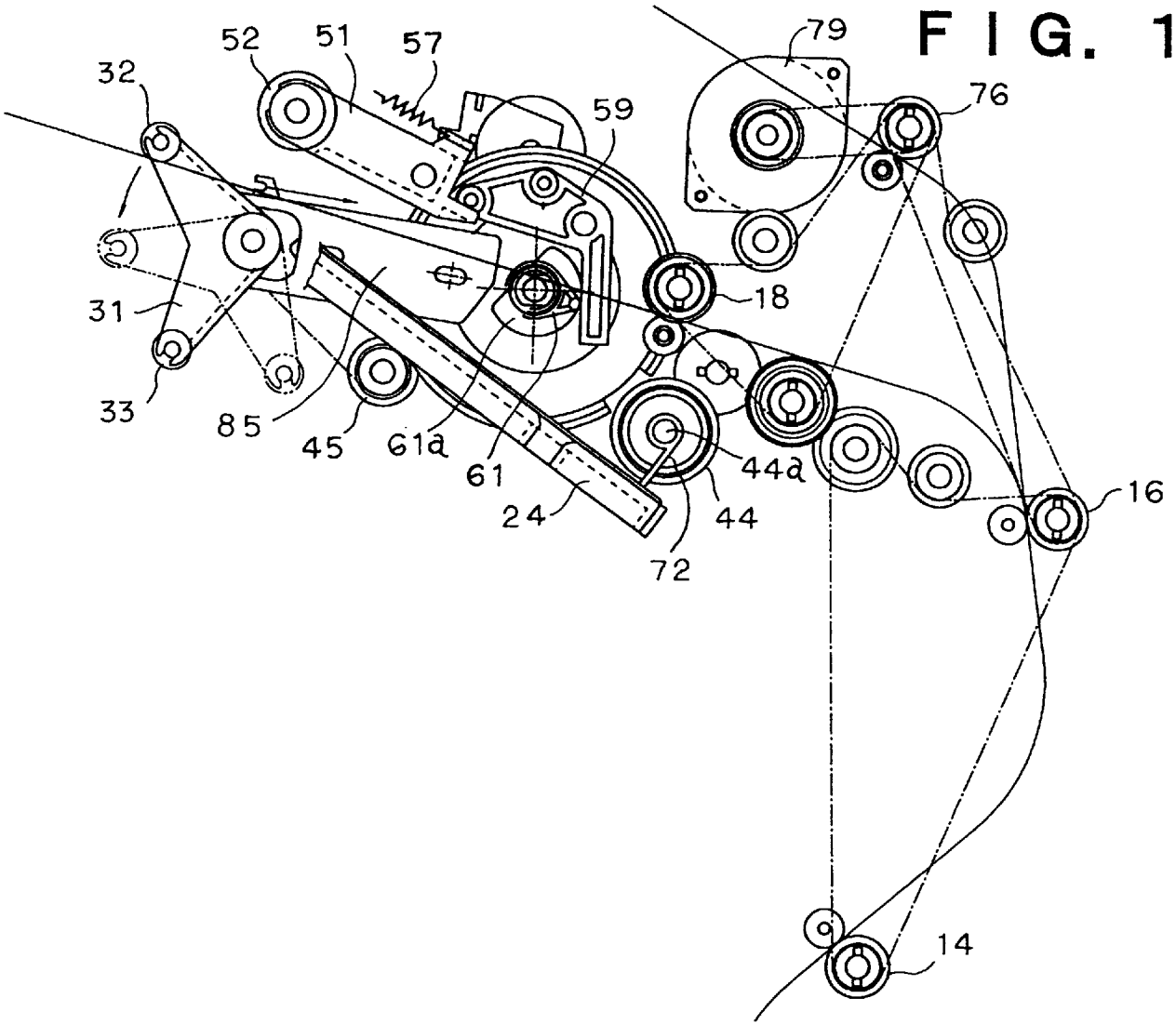
FIG. 18 is a schematic view showing a driving system of the sheet transferring in another modified example of the ejection processing section.

FIG. 17 shows a modified example of the ejection processing section 25. In the ejection processing section 25 according to this embodiment, the first mid gear 49 (FIG. 3) for transmitting rotational force from the output side gear 45 to the contacting-separating means 50 as in the above embodiment does not exist. Thus, rotational force of the output side gear 45 is transmitted only to the ejection roller 48, and is not transmitted to the side of the ejection roller 52. The arm portion 51 of the contacting-separating means 50 rotates in accordance with rotation of the center gear 41 as in the above embodiment, and the ejection roller 52 disposed at the distal end thereof is made to abut against the ejection roller 48 to nip the set of the sheets. The nipped set of the sheets is ejected to the stacking part 26 by rotation of the ejection roller 48.

Incidentally, in the present invention, the above projection member 38 can be formed by cutting and raising one part of the sheet holding part 24 which is a resin molding. The projection member 38 is elastically bent downwardly since the cut and raised portion becomes a resin hinge. Accordingly, when the sheets are temporarily stacked on the sheet holding part 24, as in the aforementioned projection member 38, an inclined surface of the projection member makes slipping down of the sheet smooth; however, in case the stapled set of the sheets is transferred onto the stacking part 26, when the ejection roller 48 and the ejection roller 52 grip the set of the sheets, the projection member 38 is elastically bent by the weight of the set of the sheets to retreat downwardly, so that there is an effect of not affecting a nipping force by the rollers 48, 52.

Also, the projection member 38 can be formed separately from the sheet holding part 24 in case the sheet holding part 24 is sheet metal workpiece. The projection member itself is not necessary to be a resin molding, and not limited to the resin molding as long as its material has smaller coefficient of friction than that of the ejection roller 41.

Furthermore, although there is explained the case such that the post-processing step is stapling in the above embodiment, the present invention can be also applied to the process for post-processing other than stapling, such as a process of opening a hole by a punch.

(A modified example 2 of the ejection processing section 25)

FIG. 18 through FIG. 22B show the other example of the ejection processing section 25. Although in the aforementioned embodiment, common driving means is used for rotating the ejection roller 48 and the ejection roller 52 as well as actuating drive timing for allowing the ejection roller 52 to contact and separate with respect to the sheet, in this embodiment, the rotation support member 31 is also rotated by the common driving source.

Figure 19:
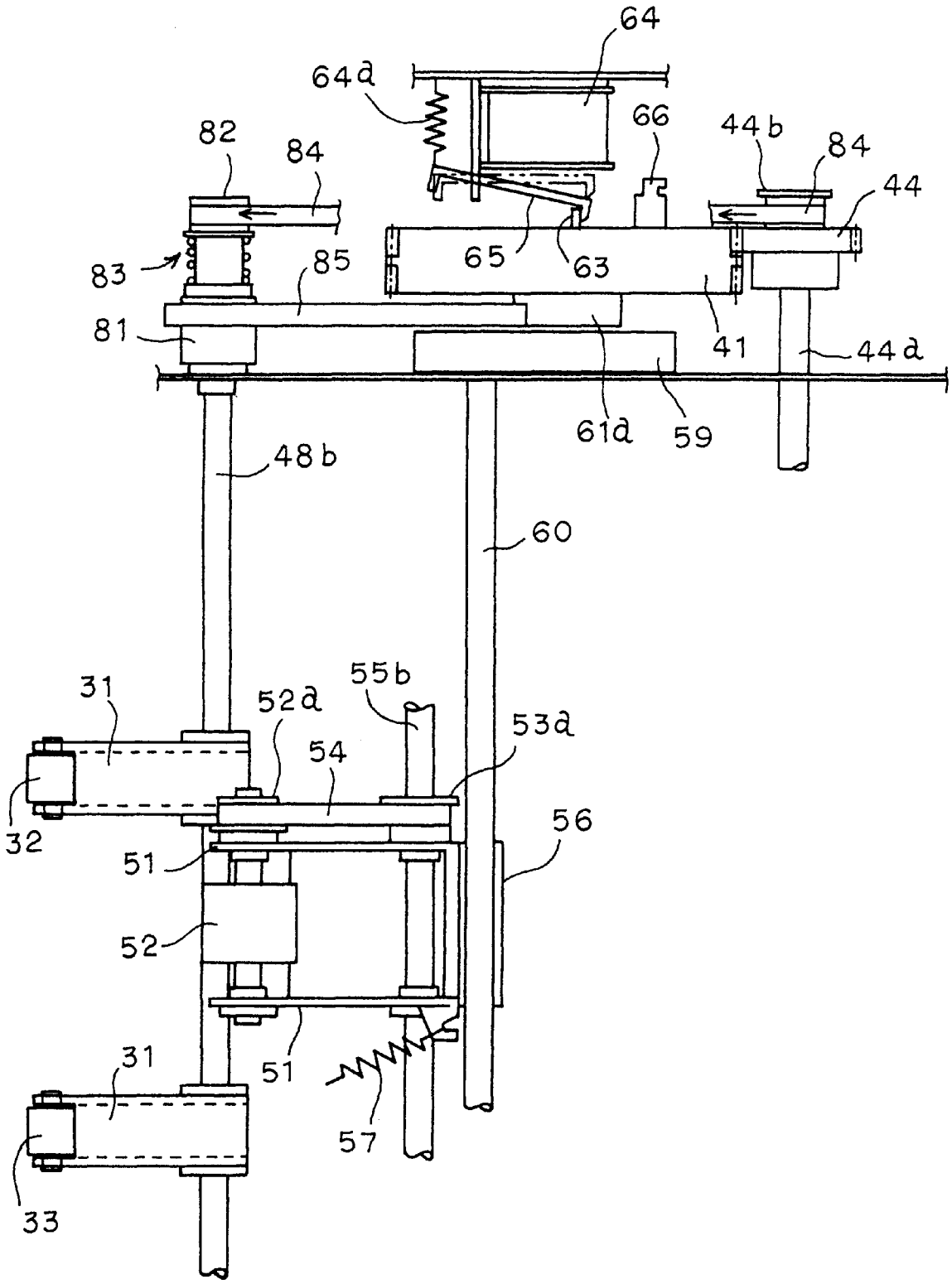
FIG. 19 is a plan view schematically showing driving and transferring means in the another modified example of the ejection processing section.

By giving the same reference numbers to the same parts as in the aforementioned embodiment, the explanation therefor is omitted herewith. As shown in FIG. 19, a pulley 44*b* is attached to the driving shaft 44*a* besides the input side gear 44.

The rotation shaft 48*b* is provided with a cam 81, a pulley 82, and a spring clutch 83 for allowing the cam 81 and the pulley 82 to contact and separate therefrom, and the pulley 82 is connected to the pulley 44*b* through a timing belt 84.

Figure 22A:
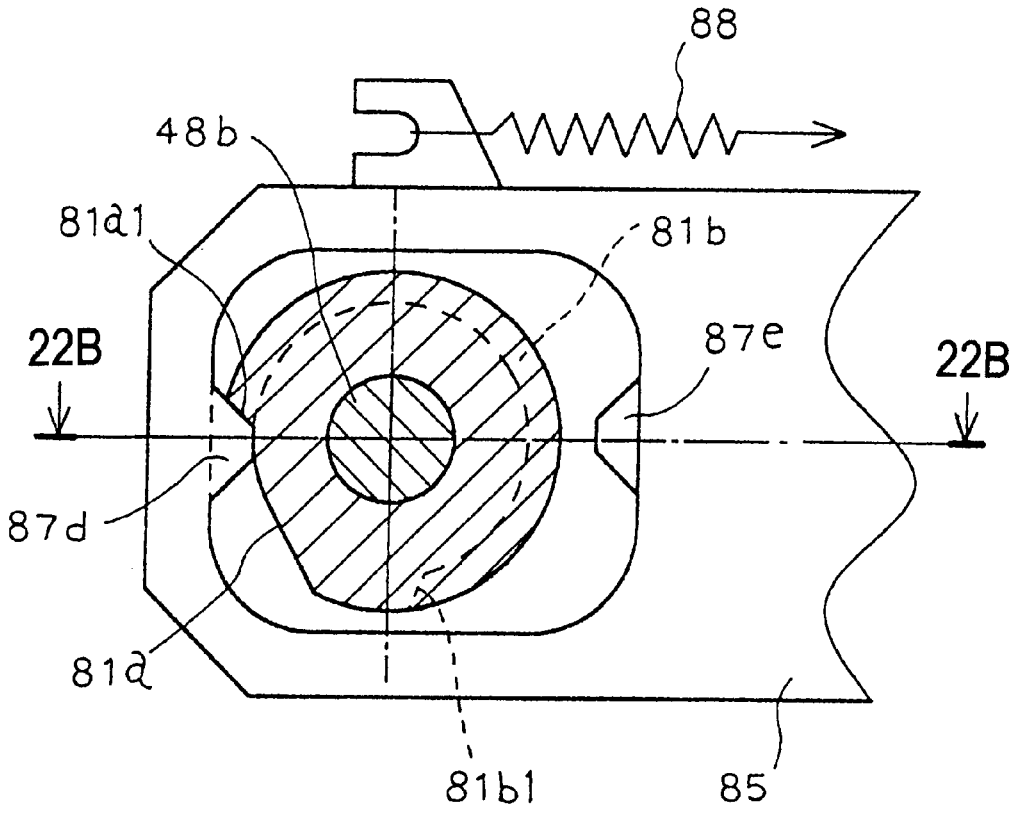
FIG. 22A and FIG. 22B are section views showing a structure of a spring clutch.
Figure 22B:
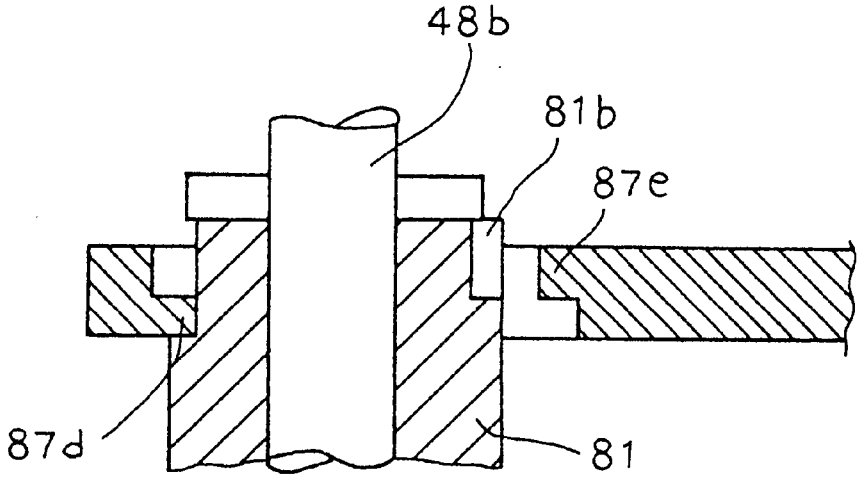

In the cam 81, a first cam concave 81*a*, which includes a control surface 81*a*1, and a second cam concave 81*b*, which includes a control surface 81*b*1, are formed in different levels as shown in FIG. 22A and FIG. 22B. Incidentally, FIG. 22B is a section view taken along line 22B—22B in FIG. 22A.

Figure 20:
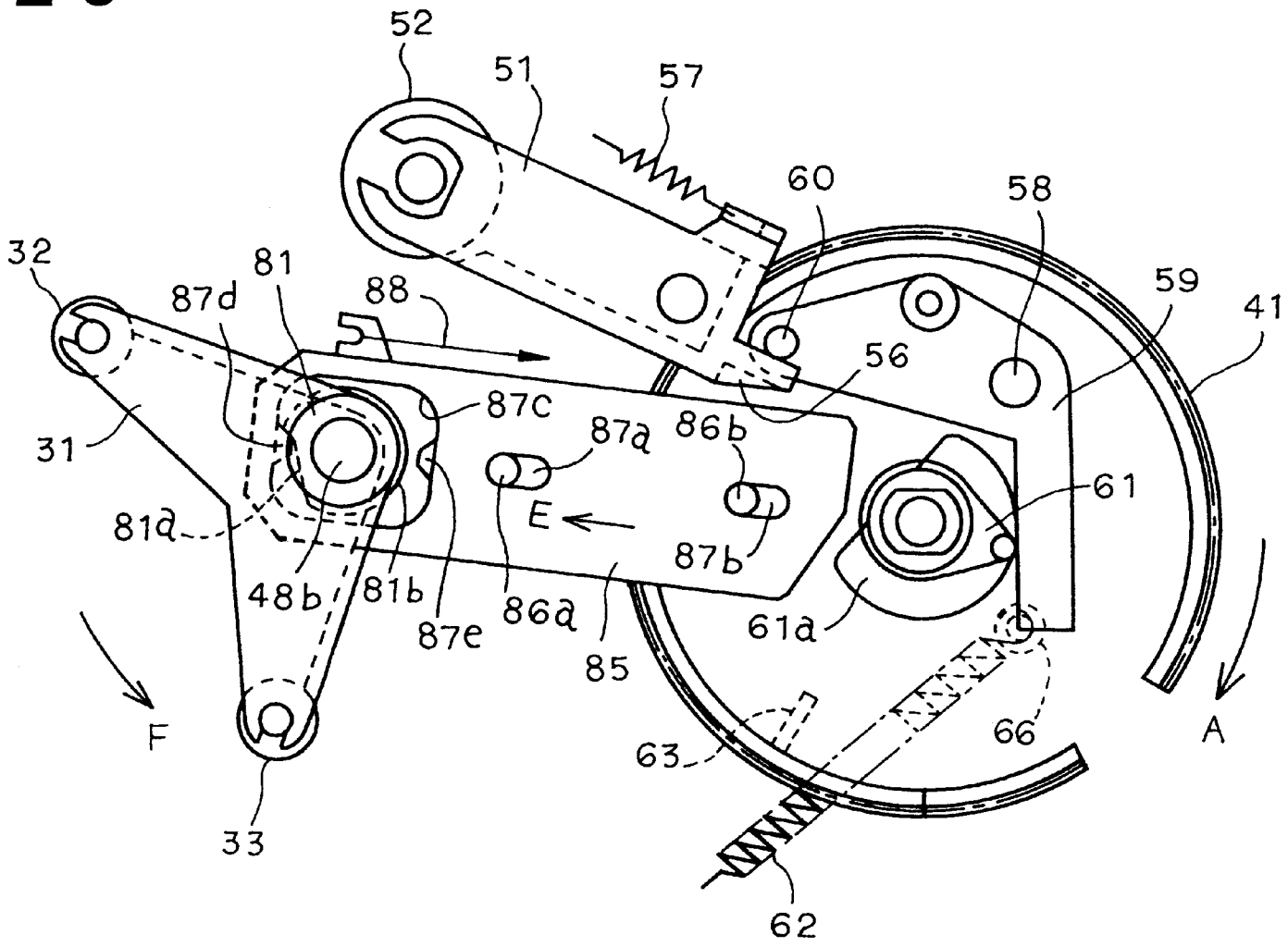
FIG. 20 is an action explanatory view showing a driving mechanism of an ejection processing section in the another modified example.

The center gear 41 is provided with a semicircular cam 61*a* besides an eccentric cam 61 as shown in FIG. 20.

The cam 61*a* is provided for transferring a mobile arm 85 along pins 86*a*, 86*b*. The mobile arm 85 includes elongated holes 87*a*, 87*b*, into which the pins 86*a*, 86*b* are inserted, an opening 87*c*, into which the cam 81 is fitted, and stoppers 87*d*, 87*e* provided around the opening 87*c*, so that the mobile arm 85 is urged by a spring 88.

In the above described structure, since drive for rotating the ejection roller 48 and the ejection roller 52, drive for the contacting-separating means 50 for contacting and separating the ejection roller 52 with respect to the sheets are the same in the aforementioned embodiment, the explanation therefor is omitted herewith, and drive for rotation support member 31 is explained.

When the input gear 44 rotates, driving is transmitted to the pulley 82 through the pulley 44*b* and the belt 84 as shown in FIG. 19. At this time, as shown in FIG. 20, since the stopper 87*d* is engaged with the control surface 81*a*1 of the cam 81, a spring of the spring clutch 83 becomes a loosened condition, so that rotation of the pulley 82 is not transmitted to the rotation shaft 48*b*. Therefore, the rotation support member 31 is located at the position shown in FIG. 20.

Under this condition, the engaging piece 65 is sucked by electrifying the solenoid 64 in FIG. 19 for the predetermined time, and when engagement between the engaging piece 65 and the stopper pin 63 is released, the center gear 41 receives a rotational force in the arrow A direction by action of the coil spring 62 as shown in FIG. 20. Accordingly, the input side gear 44 engages the first gear portion 42 of the center gear 41, and the center gear 41 starts rotating by rotation input from the input side gear 44.

When the center gear 41 rotates in the A direction, the cam 61*a* starts abutting against a base end side of the mobile arm 85, and the mobile arm 85 is moved in an E direction along the pins 86*a*, 86*b*. Accordingly, the stopper 87*d* is disengaged from the control surface 81*a*l, and the spring clutch 83 is locked so that driving force is transmitted from the pulley 82 to the rotation shaft 48*b*. As a result, the rotation support member 31 starts rotating in an F direction.

Figure 21:
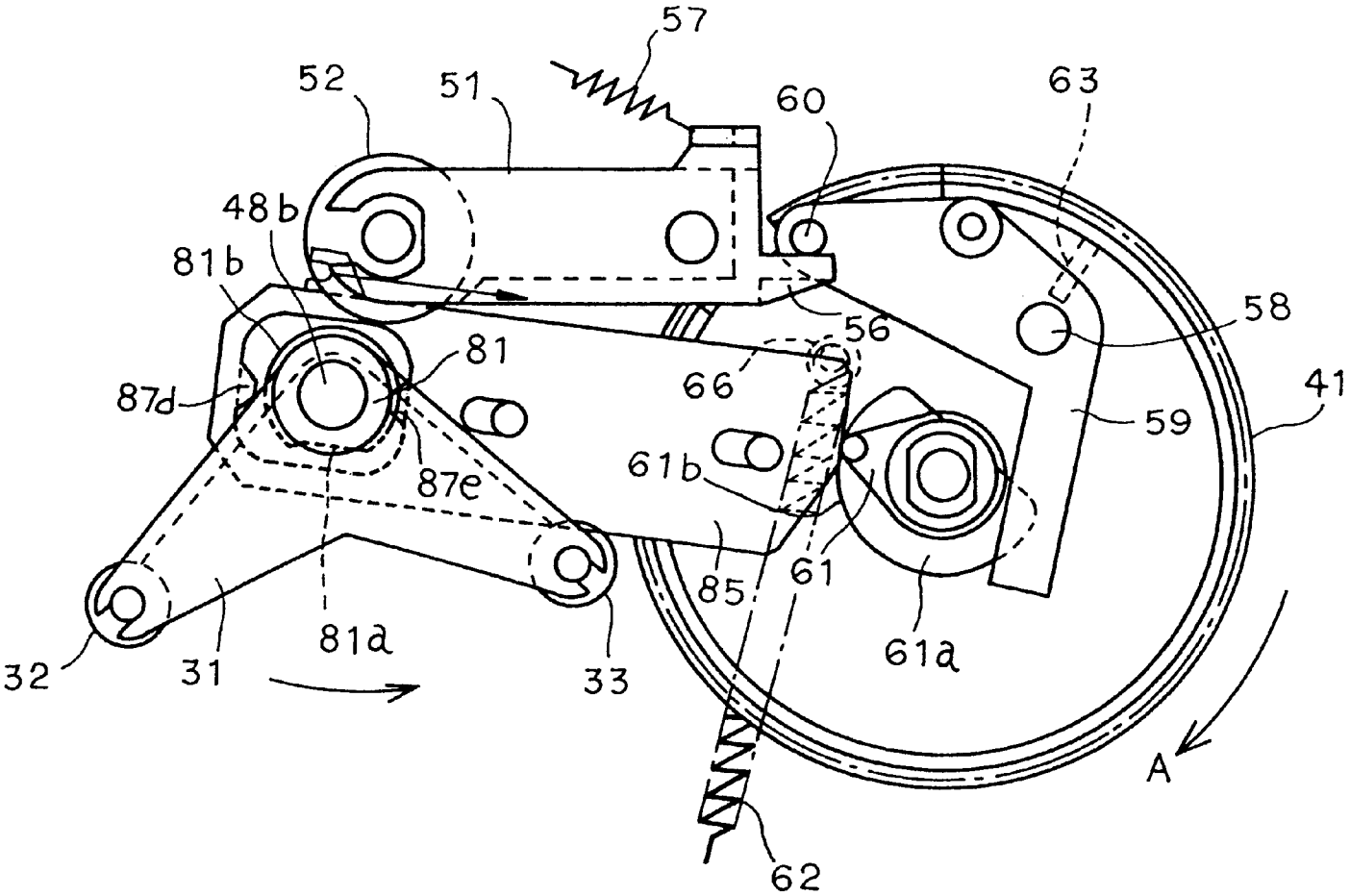
FIG. 21 is an action explanatory view showing a driving mechanism of an ejection processing section in another modified example.

When the cam 61*a* rotates as shown in FIG. 21, the stopper 87*e* engages the control surface 81*b*1, and lock of the spring clutch 83 is released, so that the rotation support member 31 stops at a position shown in FIG. 21. While a circular arc surface 61*b* of the cam 61*a* slidingly contacts with the mobile arm 85, the rotation support member 31 is stopped.

When the center gear 41 rotates further in the predetermined amount, the circular arc surface 61*b* of the cam 61*a* is separated from the mobile arm 85, and the mobile arm 85 is returned by the spring 88. Thus, the spring clutch 83 is locked, and the rotation support member 31 rotates.

Then, the center gear 41 makes one revolution so that the input side gear 44 is fitted into the notched hole 42*a* of the first gear portion 42 and the output side gear 45 is fitted with the notched hole 43*a* of the second gear portion 43; at the same time, since the stopper pin 63 is engaged with the engaging piece 65 which has been returned by the spring 64*a* extending between the solenoid 64 and the stopper pin 63, the center gear 41 is stopped and returned to the original condition shown in FIG. 20. Therefore, the rotational force of the input side gear 44 is not transmitted to the center gear 41, so that drive for ascending and descending the contacting-separating means 50, drive for rotating the first and ejection rollers 48, 52, and the rotation support member 31 are stopped.

As described above, since drive for the contacting-separating means 50, drive for rotating the first and ejection rollers 48, 52, and drive for the rotation support member 31 can be operated together based on drive for rotating the input side gear 44, driving timing can be easily adjusted, and at the same time, there is an enough space since one driving source is sufficient.

[A second embodiment]

Figure 23:
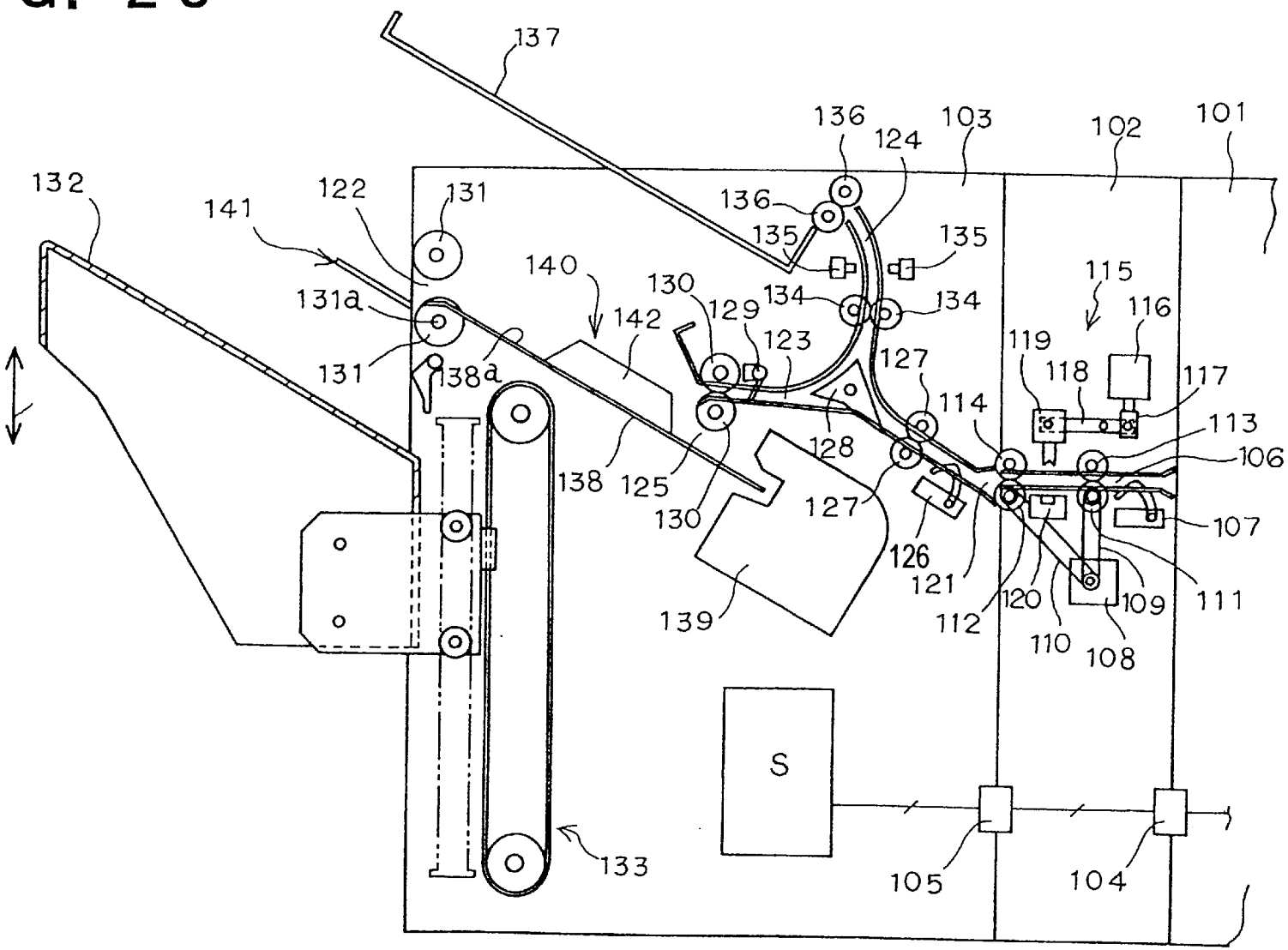
FIG. 23 is a schematic structural view showing a condition that the sheet processing apparatus in the second embodiment of the invention is attached to an image forming device.
Figure 24:
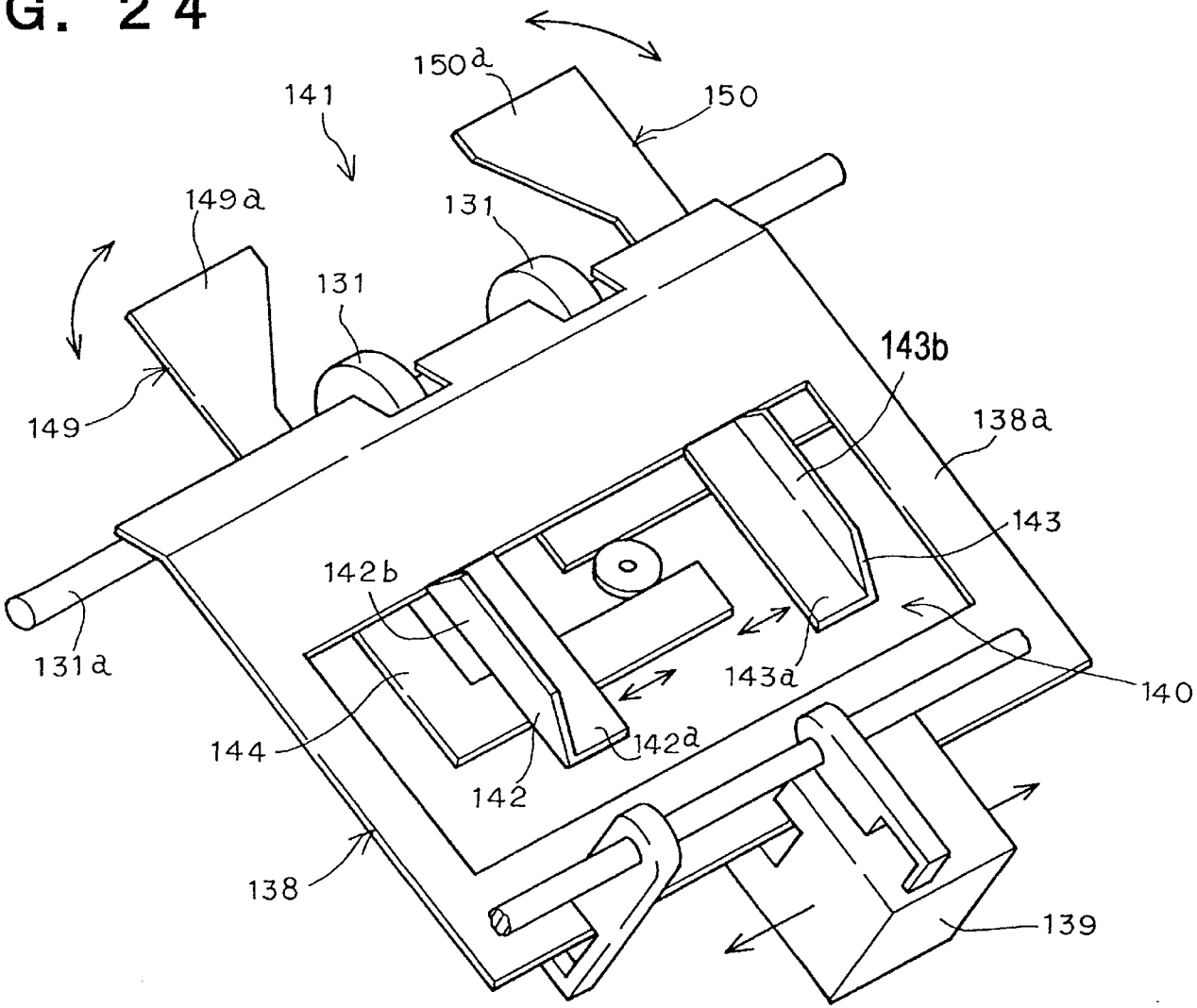
FIG. 24 is a perspective view showing a structure of the ejection processing section in the second embodiment.
Figure 25:
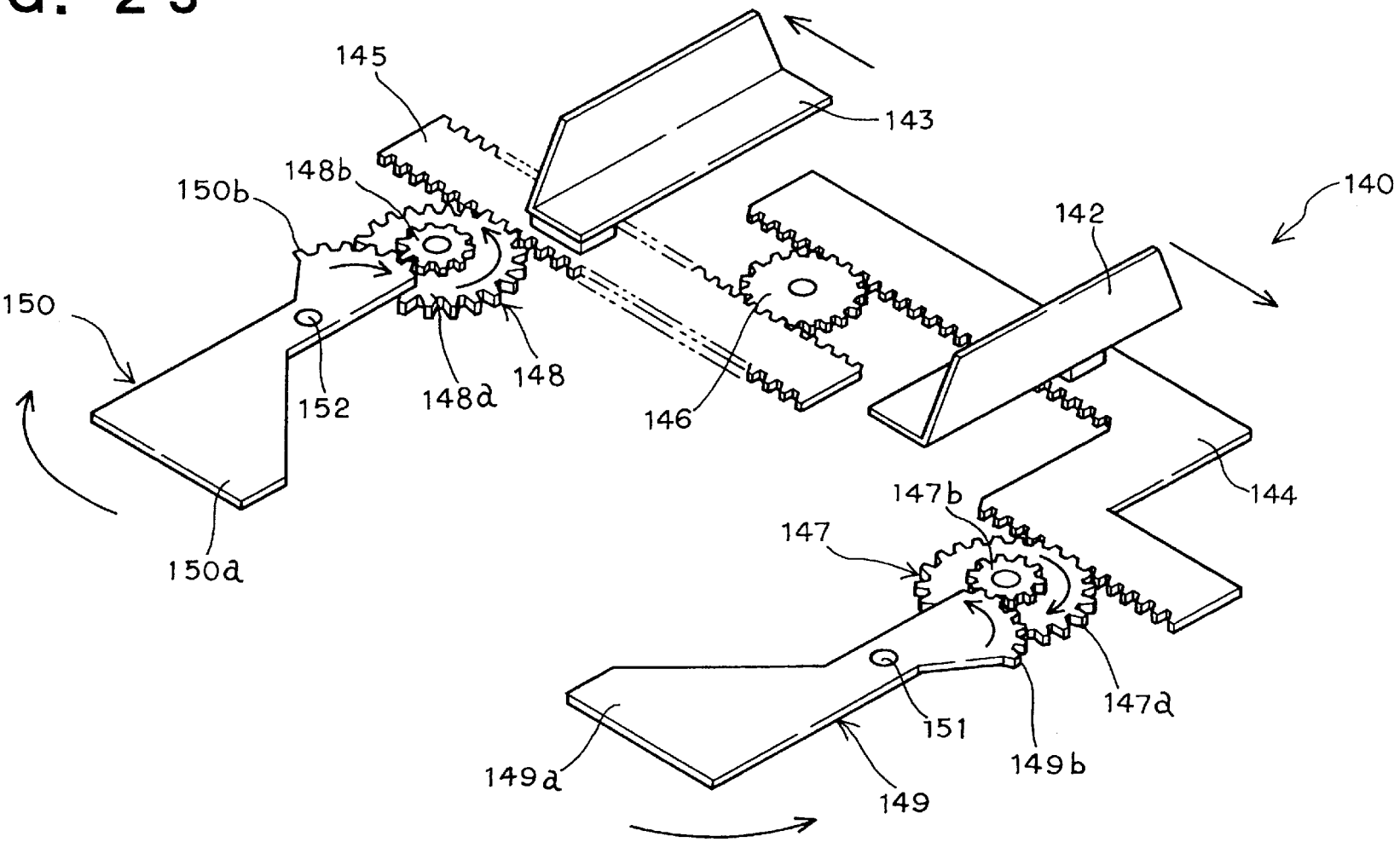
FIG. 25 is a perspective view showing structures of aligning member and auxiliary supporting means in the second embodiment.

Next, a second embodiment of the present invention is explained based on FIG. 23 through FIG. 25.

In FIG. 23, 101 designates an image forming device; 102 designates an external device which is attachable and detachable to the image forming device 101; 103 designates an ejecting device, which is attachable and detachable to the image forming device 101 or the external device 102 and includes a sort function; and 104 and 105 designate interfaces for connecting among the image forming device 101, the external device 102, and the ejecting device 103. By the interfaces 104, 105, power supply from the image forming device 101, a control signal concerning works, such as a processing mode or the like, and an information signal, such as sheet size information or the like, are outputted to the external device 102 and the ejection apparatus 103.

Incidentally, although the external device 102 and the ejecting device 103 constitute a sheet processing device in this embodiment, in case the ejecting device 103 is directly attached to the image forming device 101 without interposing the external device, the ejecting device 103 constitutes the sheet processing device.

The external device 102 is provided with a transfer path 106 for transferring a sheet, which is ejected from the image forming device 101, to the ejecting device 103; a sensor 107 disposed at a start end portion of the transfer path 106; a driving motor 108 for transferring sheets; belts 109, 110 which are rotated by drive of the driving motor 108; driving rollers 111, 112 which rotate through the belts 109, 110; driven rollers 113, 114 which are driven in contact with the driving rollers 111, 112; and a punching mechanism 115 for punching a hole out of a sheet in the transfer path 106.

The sensor 107 detects a forward end or a rear end of the sheet sent to the transfer path 106 in accordance with functions and processing modes of an automatic document feeder, not shown, or the image forming device 101.

The punching mechanism 115 is formed of a driving device 116; a driving arm 117 which is projected from the driving device 116 and is capable of expanding and contracting; a link arm 118 which rotates in cooperation with expansion and contraction of the driving arm 117; a punch 119 which moves up and down by rotation of the link arm 118; and a stock 120 located below the punch 119.

The ejecting device 103 is provided with a transfer path 123 and a post-processing path 125, which extend from a communicating port 121 of the external device 102 to an ejection port 122, and a turn-over path 124 diverged from an intermediate portion of the transfer path 123.

The transfer path 123 includes a sheet sensor 126 for detecting a forward end of a sheet supplied to the communication port 121 from the external device 102; a pair of transfer rollers 127, 127 for transferring the sheet; a path switching device 128 which leads the sheet to the turn-over path 124 in case of reversing the sheet, and switch back the reversed sheet to the transfer path 123; a count switch 129 for counting the number of the sheets; a pair of transfer rollers 130, 130; a pair of ejection rollers 131, 131, which are disposed in the vicinity of the ejection port 122, and eject the sheet supplied from the transfer rollers 130 through the ejection port 122; an ejection tray 132 located outside and below the ejection port 122; and an elevating device 133 for ascending and descending ejection tray.

Incidentally, one of the ejection rollers 131, 131 (the upper one in the figure in this case) is capable of contacting and separating with respect to the other, and in case the sheet is ejected to the ejection tray 132, the upper one approaches the other.

The turn-over path 124 is provided with a pair of switchback rollers 134, 134, a switchback sensor 135, and a pair of transfer rollers 136, 136. In passing, it is also possible that an auxiliary ejection tray 137 is disposed below the transfer rollers 136, 136 to eject the image-formed sheet on the auxiliary ejection tray 137.

The post-processing path 125 is provided with a sheet holding part 138 which spans the post-processing path 125 so as to be used in common as a part of the transfer path 123, and which extends upwardly toward the ejection port 122; a stapler 139 located at a lower end of the sheet holding part 138; aligning means 140 which abuts against an end rim of the sheet to align the sheet, and which can move in a direction perpendicularly to the sheet transfer direction; and auxiliary support means 141 which extends the post-processing path 125.

Incidentally, respective driving systems disposed in the respective paths 106, 123, 124, 125 are controlled by a post-processing control circuit S based on detected signals or the like from the respective sensors 107, 126, 129, 135, and sheet size information from the image forming device 101.

As shown in FIG. 24 and FIG. 25, the aligning means 140 is provided with a pair of guide members 142, 143 which are capable of approaching and separating from each other; plate members 144, 145 which respectively fix the guide members 142, 143; and a gear 146 which engages both the plate members 144, 145 to make the guide members 142, 143 approach and separate. Incidentally, the gear 146 is rotated by a motor (not shown) or the like, which is actuated and controlled by the control circuit S based on the processing mode or sheet size information.

The guide members 142, 143 include placing surfaces 142*a*, 143*a* in the same plane as an upper surface 138*a* of the sheet holding part 138 so that in case the set of the sheets is stapled by the stapler 139, the sheets are placed thereon in cooperation with the sheet holding part 138; and guide plates

142*b*, 143*b* which are projected upwardly from the placing surfaces 142*a*, 143*a*, and guide a lower surface of the sheet slidingly in case the sheets are not stapled.

The auxiliary support means 141 is provided with linking gears 147, 148 which engage the plate members 144, 145, and are rotated by displacement of the plate members 144, 145 in accordance with rotation of the gear 146; and arms 149, 150 including auxiliary support means, for example, substantially triangle auxiliary support surfaces 149*a*, 150*a* which are respectively projected in an approaching direction.

The link gears 147, 148 are formed of large-diameter gears 147*a*, 148*a* which engage the plate members 144, 145, and small-diameter gears 147*b*, 148*b* which are coaxial to the large-diameter gears 147*a*, 148*a*.

The arms 149, 150 are rotatable on shafts 151, 152 as fulcrums, and include fan-shaped gears 149*b*, 150*b* which engage the small-diameter gear 147*b*, 148*b*. Also, the arms 149, 150 are rotated between a retreating position, in which the supplied sheet is not supported by the arms, and is stacked on the ejection tray 132 as it is, and a supporting position in which the forward end of the supplied sheet is supported by the arms.

In this case, since the arms 149, 150 overlap the ejection tray 132 thereabove, they contribute to miniaturize the ejection apparatus 103 small. Also, based on the sheet size information from the control circuit S, the arms 149, 150 are rotated from the retreating position to the support position for an amount which is adequate to the sheet size.

In this case, although displacement of the guide members 142, 143 is made also for an amount corresponding to the sheet size, in case of not stapling, the lower surface of the sheet is slidingly guided by the guide plates 142*b*, 143*b*, and at the same time, from the necessity that the arms 149, 150 should be located at the retreating position of not supporting the sheet, to satisfy the condition, an amount of displacement of the plate members 144, 145 and an amount of rotation of the arms 149, 150 are set by gear ratio of the fan-shaped gears 149*b*, 150*b*.

In the above described structure, in case of not stapling, based on mode selection information and sheet size information from the image forming device 101, the guide members 142, 143 approach the position in which the lower surface of the sheet slidingly contacts the guide plates 142*b*, 143*b*, and at the same time, the arms 149, 150 are located at the retreating position. Also, the ejection rollers 131, 131 are in the approaching condition.

The sheet supplied from the external device 102 to the transfer path 123 is transferred by the transfer rollers 127, 127 and the transfer rollers 130, 130, and stacked onto the ejection tray 132 by the ejection rollers 131, 131 in the approaching condition. At this time, in case the sheet is a double-sided document, the sheet once goes by way of the turn-over path 124 to be reversed, and then ejected.

On the other hand, in case of stapling, based on mode selection information and sheet size information from the image forming device 101, the guide plates 142*b*, 143*b* are separated more than the width of the sheet, and at the same time, the arms 149, 150 are moved to the supporting position corresponding to the size of the sheet. Also, the ejection rollers 131, 131 are in the separated condition.

The sheet supplied from the external device 102 to the transfer path 123 is transferred by the transfer rollers 127, 127 and the transfer rollers 130, 130, and once dropped onto the sheet holding part 138 so as to be stacked successively by spanning the upper surface 138*a* of the sheet holding part 138, the placing surfaces 142*a*, 143*a*, and the arms 149, 150. At this time, in case that the sheet is a double-sided document, the sheet once goes by way of the turn-over path 124 to be reversed, and then is stacked.

Then, when stacking the predetermined number of the sheets is counted by count of the count switch 129, the guide members 142, 143 approach each other such that the guide plates 142*b*, 143*b* abut against the end rims of the sheet to align the set of the sheets, and after aligning process by the predetermined times of approaching and separating is finished, the stapler 139 is actuated to staple; then the ejection rollers 131, 131 approach each other, and at the same time, the arms 149, 150 are rotated to the retreating position so that the stapled set of the sheets is ejected onto the ejection tray 132.

[A third embodiment]

Figure 26:
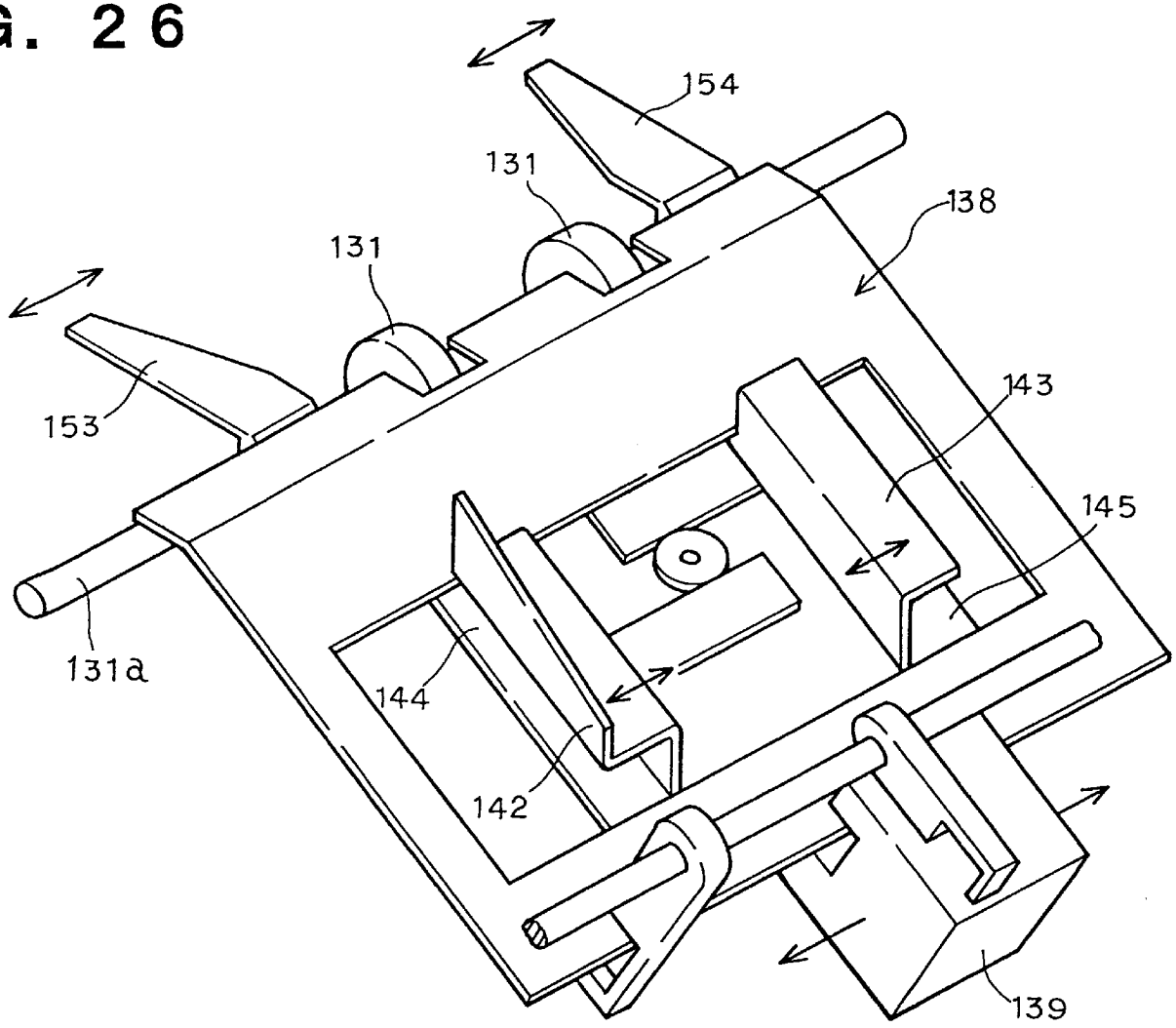
FIG. 26 is a perspective view showing a structure of the ejection processing section in the third embodiment.
Figure 27:
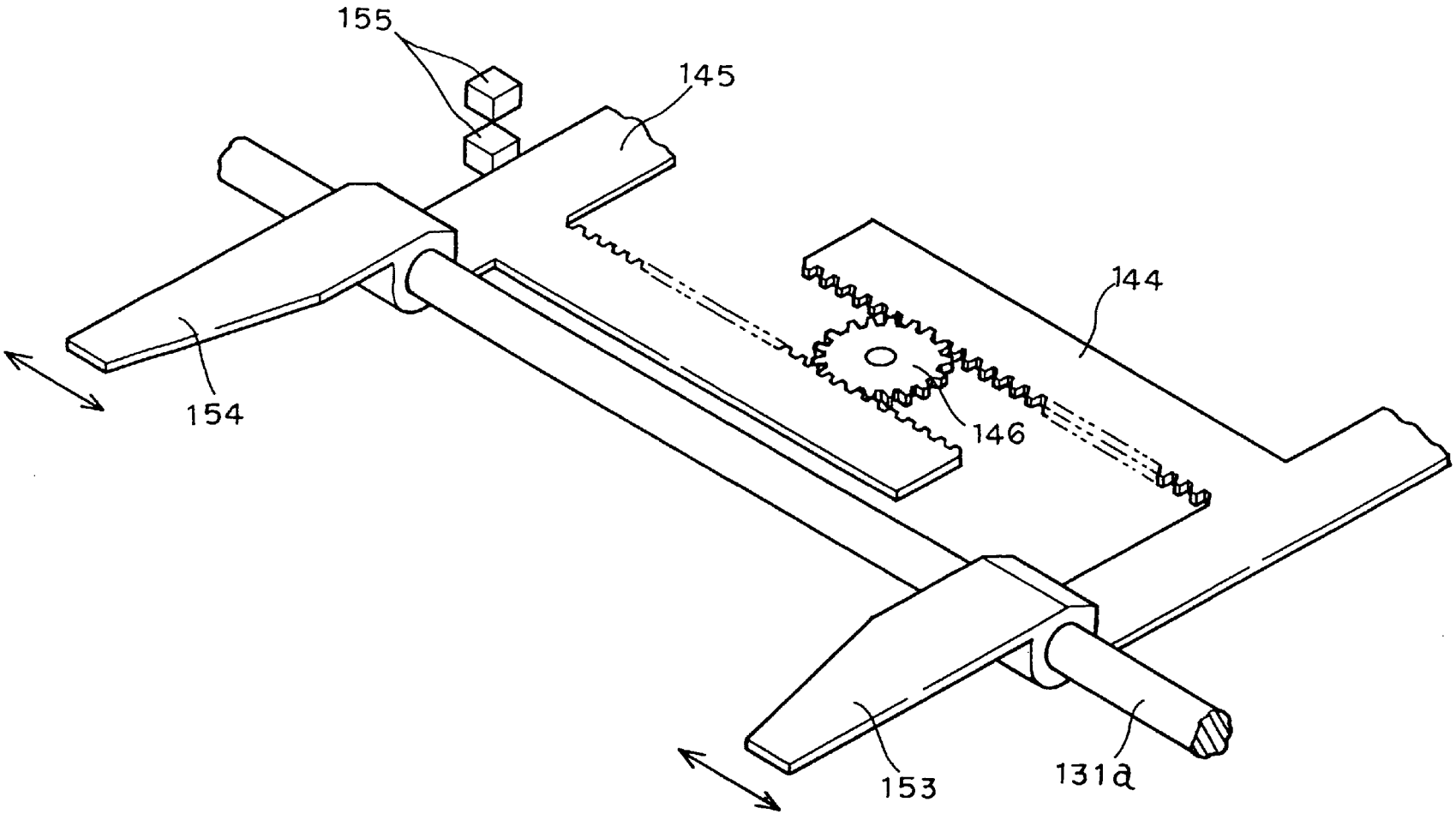
FIG. 27 is a perspective view showing structures of aligning member and auxiliary support means in the third embodiment.

Next, a third embodiment of the present invention is explained based on FIG. 26 and FIG. 27.

Although there is disclosed a type in which the arms 149, 150 rotate in the second embodiment, as shown in FIG. 26 and FIG. 27, arms 153, 154 which are displaced along the width direction of the sheet can be supported by a rotation shaft 131*a* of the ejection roller 131.

In this case, by coupling to the plate members 144, 145, the arms 153, 154 can be displaced in cooperation with displacement of the guide members 142, 143 in accordance with rotation of the gear 146. Incidentally, numeral 155 in the figure designates a home position sensor which detects a home position of the plate member 144 (the same as the retreating position of the arms 153, 154).

As described above, since the arms 149, 150 and the arms 153, 154 are rotated or displaced along the sheet width direction, the arms 149, 150, 153, 154 can be moved to the retreating position and the supporting position by minimum moving, so that reduction of the process time can be achieved.

What is claimed is:

1. A sheet processing device having stationary support means for supporting one or more sheets supplied from image forming means, ejecting means for ejecting said one or more sheets supported by the support means, and stacking means for stacking said one or more sheets ejected from the support means by the ejecting means, wherein said sheet processing device further includes:

auxiliary support means disposed on a forward side in an ejection direction of a sheet on the support means, said auxiliary support means rotating between a support position for supporting at least the forward side of the sheet and a retreating position retreated from said support position.

2. A sheet processing device according to claim 1, wherein the auxiliary support means is retracted from the support position at least until a rear end of the sheet is ejected from the ejecting means when the sheet is ejected from the support means to the stacking means.

3. A sheet processing device according to claim 1, wherein the center of rotation of the auxiliary support means is the same as a center of rotation of the ejecting means and is rotatable independently.

4. A sheet processing device according to claim 1, wherein a forward end of the auxiliary support means is provided with means for reducing frictional resistance against said one or more sheets.

5. A sheet processing device according to claim 1, further comprising post-processing means for carrying out a post process on a rear end of the sheet in a sheet ejection direction after at least the rear end in the sheet ejection direction of said one or more sheets supported by the support means is aligned, and driving means for allowing the auxiliary support means to repeat contacting and separating with respect to the sheet when the rear side in the sheet ejection direction of the sheet on the support means is to be aligned before carrying out the post process.

6. A sheet processing device according to claim 1, wherein the auxiliary support means is rotated to a larger tilt angle at the support position when the sheet is aligned on the support means than an auxiliary support tilt angle when said one or more sheets are supplied from the image forming means to the support means.

7. A sheet processing device according to claim 1, wherein the auxiliary support means differentiates a tilt angle at the support position according to a size, material, and thickness of said one or more sheets stacked on the support means.

8. A sheet processing device according to claim 1, wherein the auxiliary support means includes at least two arms, said at least two arms having distal ends including rollers for reducing frictional resistance against said one or more sheets.

9. A sheet processing device according to claim 8, wherein when one of said at least two arms of the auxiliary support means is located at the support position, the roller of the distal end of the other arm abuts against an upper surface of the sheet stacked on the stacking means.

10. A sheet processing device according to claim 9, wherein the stacking means is freely ascendable and descendable and includes a driving part having an urging force in an ascending direction.

11. A sheet processing device, comprising:

stationary support means for supporting one or more sheets supplied from image forming means, first ejecting means for contacting one of the surfaces of said one or more sheets supported by the support means, second ejecting means for contacting the other of the surfaces of said one or more sheets, contacting-separating means for allowing the second ejecting means to contact and be separated from the other of the surfaces of said one or more sheets, and auxiliary support means disposed at a forward side in a sheet ejection direction on the support means, said auxiliary support means rotating between a support position in which at least the forward side of the sheet is supported and a retracted position for retreating from the support position.

12. A sheet processing device according to claim 11, further comprising driving means for driving at least the first ejecting means after an operation of contacting the second ejecting means with the sheet.

13. A sheet processing device according to claim 11, further comprising common driving means for controlling drive timings of at least the first ejecting means and the contacting-separating means.

14. A sheet processing device according to claim 13, wherein the driving means also drives the second driving means when driving the first ejecting means.

* * * * *